US006966272B2

(12) United States Patent
Freelund et al.

(10) Patent No.: US 6,966,272 B2
(45) Date of Patent: Nov. 22, 2005

(54) MULTI-MODE SHIP FOR TRANSPORTING VEHICLES

(75) Inventors: Avrum A. Freelund, Glen Cove, NY (US); Byron M. Sugahara, Morristown, NJ (US); Kent A. Merrill, Hoboken, NJ (US); Ronald E. Williamson, New York, NY (US)

(73) Assignee: Great American Lines, Inc., Wilmington, DE (US)

( * ) Notice: Subject to any disclaimer, the term of this patent is extended or adjusted under 35 U.S.C. 154(b) by 0 days.

(21) Appl. No.: 10/792,433

(22) Filed: Mar. 3, 2004

(65) Prior Publication Data

US 2005/0193937 A1 Sep. 8, 2005

(51) Int. Cl.[7] ..... B63B 25/02
(52) U.S. Cl. ..... 114/73
(58) Field of Search ..... 114/70, 72, 73, 114/74 R; 211/85.8

(56) References Cited

U.S. PATENT DOCUMENTS

| | | | | |
|---|---|---|---|---|
| 3,138,131 A | * | 6/1964 | Szychlinski | 114/72 |
| 3,387,581 A | | 6/1968 | Suganuma | 114/72 |
| 3,440,990 A | | 4/1969 | Van Riet et al. | 114/72 |
| 3,583,350 A | | 6/1971 | Goldman | 114/72 |
| 4,002,135 A | | 1/1977 | Tornqvist | 114/72 |
| 4,008,675 A | | 2/1977 | Johansson | 114/70 |
| 4,111,145 A | | 9/1978 | Ohsaka | 114/72 |
| 4,884,521 A | | 12/1989 | Belinsky | 114/72 |
| 5,526,940 A | * | 6/1996 | Shea et al. | 211/85.8 |
| 6,105,525 A | | 8/2000 | Rapeli | 114/72 |
| 6,135,044 A | | 10/2000 | Nielsen | 114/74 |
| 6,223,669 B1 | | 5/2001 | Bowden | 114/65 |

* cited by examiner

*Primary Examiner*—Lars A. Olson
(74) *Attorney, Agent, or Firm*—Patton Boggs LLP

(57) ABSTRACT

The multi-mode ship uses bulk cargo flow-through vehicle decks that are capable of supporting commercial vehicles, military vehicles, and other general cargo. Bulk cargo is loaded into the multi-mode ship with a bulk cargo transport system. Bulk cargo is loaded on board the multi-mode ship and is discharged from some or all of the vehicle decks, where the bulk cargo flows downward through the vehicle decks and settles on the bottom of the multi-mode ship. The bulk cargo then piles upward through the vehicle decks until it reaches the desired load. The bulk cargo transport system includes conveyors, upper and lower, and at least one vertical conveyor for transporting bulk cargo to, from, and within a cargo hold of the multi-mode ship. Further, the multi-mode ship preferably includes liquid storage tanks that are shaped to provide a preferably funnel-like storage area within the cargo hold for funneling bulk cargo toward the lower conveyors of the bulk cargo transport system to further provide efficient and complete unloading of the cargo hold of bulk cargo.

32 Claims, 12 Drawing Sheets

MULTI-MODE SHIP FOR TRANSPORTING VEHICLES

FIELD OF THE INVENTION

This invention relates to ships and in particular to cargo ships for efficiently transporting vehicles and equipment in one direction and bulk and liquid cargo in the other, or any combination of these types of cargoes simultaneously without having to reconfigure the ship's cargo hold and decking configurations.

Problem

It is a problem in the field of marine shipping for a ship with a roll-on/roll-off (RO/RO) deck structure to be able to carry vehicles and equipment to a point of destination, quickly offload this cargo and quickly reload the ship with another type of cargo, such as bulk and/or liquid cargo without having to expend time reconfiguring the cargo hold, decking structure, or both. Many attempts have been made to design ships that are capable of carrying different type cargoes on different voyages or different type cargoes simultaneously on the same voyage.

In addition, a further problem exists in certain shipping trades because specialized characteristics that make a ship an efficient carrier of a particular cargo moving in one direction can make the same ship entirely unsuitable to carry the cargoes which are available in the return direction, thus creating the need to transport or carry non-profitable ballast on the return voyage. This problem is particularly severe in the case of pure car carriers (PCC's) and pure car and truck carriers (PCTC's) whose design is optimized for the loading, carriage, and discharge of vehicles which are driven on and off and stowed under their own power.

In early times, cargo ships were differentiated by such characteristics as size, speed, draft, or sail arrangement, but not by type of cargo. The goal of the ship's designer was to make every vessel suitable for all cargoes. This goal was largely achieved, and the inefficiencies inherent in achieving it were accepted. This situation began to change with the introduction of iron and steel ships and steam propulsion whose cost demanded more efficient revenue generation. The change which began with the introduction of specialized tank vessels has now progressed to the point where the traditional general cargo vessel has all but disappeared from the high seas, to be replaced by the container ship, which carries general cargo in shore-loaded standardized containers, and by specialized vessels which carry the various cargoes once carried by the general cargo vessels. Among these are PCC's and PCTC's.

The movement of cars by sea started with the transport of small numbers of vehicles in general cargo vessels, many of which were then modern ships in liner service (i.e., following a regular schedule). These liner vessels were usually 'tween deckers, ships whose deep lower holds were separated from the upper deck by one or two intermediate ('tween=between) decks. Cars were lifted to and from the 'tween decks by shoreside or ship's lifting gear. The number of cars that could be carried in a ship was limited, the liner's discharge and loading ports might require extensive land transport of the cars, and the cars were susceptible to damage in the lift on/lift off loading process.

Next, bulk carriers were fitted with folding decks. Emphasis was on bulk cargoes with cars as backhaul. The demand for movement of large lots of cars led to their shipment in bulk carriers, open hold vessels, generally large, used for the carriage of cargoes shipped in bulk such as grain, ores, and coal, and fitted with folding decks on which the cars were stowed; cars were loaded by the lift on/lift off method. Bulk carriers were able to carry larger quantities of cars, but the cars were still exposed to damage in the loading and discharge process, risked being dirtied by residue from previous cargoes like coal, and loading and discharge port selection was driven by the needs of the bulk cargoes, cars being the secondary or backhaul cargo.

The growing volume of cars moving by sea and the demands of the car shippers for high quality service led to the design and construction of PCC's, vessels dedicated to the carriage of cars and, at least in intent, optimized for that purpose. One of the most notable features of the PCC was roll on/roll off loading and discharge. A series of external and internal ramps made it possible to drive the cars onto the ship and to their stowage location, and to discharge by the same method. This roll on/roll off loading and discharge resulted not only in reduced in-port time, but in greatly reduced handling damage to the cars as well. Furthermore, since the PCC was optimized for the carriage of cars, a relatively light cargo, their design could incorporate a much finer hull than the car-bulkers, permitting more favorable speed and fuel consumption characteristics.

Automobile carriage in PCC's, as compared with carriage in car-bulkers, resulted in faster transit time, less damage, no contamination by residue from previous dirty cargoes and the routing and port selection flexibility available to a primary cargo. The advantages of PCC's over car-bulkers were sufficient to impel many vehicles manufacturers to bar shipment of their product in car-bulkers. With all the advantages the PCC has, however, it remains a highly specialized vessel which is unsuited to other than roll on/roll off (RO/RO) cargoes and which has little opportunity to find backhaul cargoes of this type. Some relevant examples of developments related to this art are listed below.

U.S. Pat. No. 6,223,669 describes a ship designed to simultaneously carry different type loads, such as wheeled vehicles and standard containers. This ship is not designed to carry large amounts of one, two or three different types of cargoes. It is specialized to carry a large variety of limited amounts of cargoes. Furthermore, this ship design is not intended to carry large amounts of bulk cargo on one voyage and wheeled vehicles on the return trip, or both simultaneously.

U.S. Pat. No. 6,105,525 describes a ship designed to simultaneously carry different type loads, such as wheeled vehicles and container cargoes. A central self-supporting structure that holds cars and other palletized loads within the cargo hold of the ship creates a peripheral area whereby container cargoes are placed between the central self-supporting structure and the hull of the ship. Bulk cargo is stored in the bottom of the vessel and is limited by the self-supporting structure.

U.S. Pat. No. 6,135,044 describes a ship designed to simultaneously carry liquid in large containers and a plurality of standard containers, but not bulk loads. The ship design further does not comprise a roll-on/roll-off decking arrangement for fast loading and unloading of wheeled vehicles.

U.S. Pat. No. 4,884,521 describes a ship designed to simultaneously carry break bulk cargo, palletized cargo, and outsized cargo by the use of rotatable deck sections that are adjacent to cellular sections for standard containers. With the deck sections in a vertical position a space is defined to store additional standard containers. With the deck section in a horizontal position, the deck sections store palletized and break bulk cargo. The ship design does not allow roll-on/roll-off loading and unloading of wheeled vehicles nor is it designed to carry bulk cargoes, such as grain.

U.S. Pat. No. 4,111,145 describes a ship designed to simultaneously carry wheeled vehicles and bulk cargoes. However, the wheeled vehicle roll-on/roll-off design requires that a hingeable and rotatable ramp connect with each vehicle deck individually and only one at a time to enable wheeled vehicles to exit the ship. Furthermore, the bulk and packaged storage area in the bottom of the ship is limited in size by the deck directly above it and loading and unloading of bulk and packaged loads are provided through hatches by derrick booms.

U.S. Pat. No. 4,008,675 describes a ship designed for roll-on/roll-off storage of wheeled vehicles having a cargo carrying portion. The cargo carrying portion is subdivided into fully separated cargo volumes formed as straight, blind alleys, each emanating from a lobby. The cargo portions do not provide for bulk storage.

U.S. Pat. No. 4,002,135 describes a ship designed for simultaneous storage and transport of bulk or liquid and general cargo, such as wheeled vehicles. The bulk cargo is confined to the space defined by the hull and the lowest fixed deck. Conveyors, pipe lines, and/or pumps load and unload bulk cargo under the main deck.

U.S. Pat. No. 3,583,350 describes a ship designed with temporary 'tween decks to support cargo such as containers, pallets or the like. When the 'tween decks are in a stowed position, the ship transports bulk cargo. Effort must be expended to move these 'tween decks into and out of position. Further, this ship is not designed for roll-on/roll-off loading and unloading of wheeled vehicles.

U.S. Pat. No. 3,440,990 describes a ship designed to carry bulk cargo in one direction and general cargo in another. The ship includes an intermediate deck that is folded from a less than vertical stowed position into a horizontal position. This intermediate deck supports false deck members to provide a continuous deck for supporting general cargo. This deck must be placed in its stowed position before bulk cargo can be loaded in the ship for transport.

U.S. Pat. No. 3,387,581 describes a ship designed to carry bulk cargo in one direction and general cargo in another. The ship includes a plurality of intermediate decks that are folded from a less than vertical stowed position into a horizontal position. These intermediate decks support false deck members to provide a plurality of continuous decks for supporting general cargo. These decks must be placed back in their stowed position before the bulk cargo can be loaded in the ship for transport.

In addition, ships with flat bottom holds transporting grain or other bulk cargo require the use of mobile mechanized machinery, such as small front loaders, to move the grain or bulk cargo to the longitudinal conveyor or pneumatic equipment to discharge the grain or bulk cargo to the pier.

Therefore, there is a need for a ship design that facilitates efficient loading and unloading of different types of cargoes without the necessity of moving decks and deck supports to accommodate the different types of cargoes. Furthermore, there is a need for a ship design to provide for self loading/off-loading for bulk cargoes.

Solution

The above described problems are solved and a technical advance achieved in the art by the present multi-mode ship design. The present design has the general appearance of a PCC or PCTC, but it is far more versatile than a PCC or PCTC with regard to the cargoes it can carry, and it is preferably faster by several knots as well.

The multi-mode ship is designed to carry bulk cargoes, including "clean" bulk cargoes or food grade bulk cargoes such as wheat, rice, soy bean meal, grains, etc. These bulk cargoes are carried in a bulk cargo hold in the lower part of the ship which is designed to permit alternate carriage of either vehicles or bulk cargoes. The multi-mode ship also provides a bulk cargo transport system for self loading and unloading of bulk cargo. The design further provides for a bulk/car compartment that is cleaned to car carriage standards, by broom sweep and air spray, water wash, and/or vacuum trucks. The car ventilation systems are preferably isolated when bulk cargoes are handled.

A feature of the multi-mode ship is a bulk cargo transport system that permits the loading and unloading of the bulk cargo hold while keeping non-bulk compartments clear of any contact with the bulk cargoes. This system include vertical and horizontal conveyor systems and adjustable discharge booms and loading hoppers.

Another feature of the multi-mode ship is the design and construction of the vehicle decks that provides support for vehicles and general cargo during transportation. Those vehicle decks also provide a flow-through passage among the vehicle decks to enable the loading of bulk cargo through the vehicle decks and storage of bulk cargo among the vehicle decks when the multi-mode ship is transporting bulk cargo. The vehicle decks are comprised of subway grating or other type of flow through panels for supporting vehicles in the bulk cargo hold(s). In addition, the multi-mode ship provides for structural details within the bulk cargo hold that will avoid bulk cargo being trapped or retained, thus minimizing cleaning requirements. In one aspect of the present multi-mode ship, all vehicle decks are grating decks. In this aspect, the vehicle decks are designed to provide the necessary structural support of the solid decks, such as a weatherdeck to the multi-mode ship. In another aspect of the present multi-mode ship, some of the vehicle decks are grating decks. In this aspect some solid decks, such as a weather deck, are used to provide structural support to the multi-mode ship.

Contamination of vehicle hold ventilation system by bulk cargoes is prevented by the fitting of air-tight closures on the supply and discharge ventilation duct openings of the ventilation ducts in the bulk/car cargo holds.

Another feature of the multi-mode ship design is that it preferably provides the ship with bulk liquid cargo tanks, including vertical tanks suitable for oil or bulk cargoes. The liquid cargo tanks may also be used to carry high flashpoint liquids and clean oils (e.g., edible oils). These liquid cargo tanks could be either coated or constructed of stainless steel and are preferably fitted with tank washing machines.

SUMMARY

The invention provides a multi-mode ship capable of transporting different types of cargo, comprising: a load-bearing hull having a bottom structure and a side structure; a cargo space capable of carrying a bulk cargo defined within the hull; a plurality of substantially grated vehicle decks located in the cargo space and attached to the load-bearing hull; and at least one vehicle ramp that connects at least two of the plurality of substantially grated vehicle decks, arranged in such a way as to provide a standard roll-on/roll-off orientation between the plurality of substantially grated vehicle decks and the load bearing hull, wherein the plurality of substantially grated vehicle decks provides unimpeded flow-through of the bulk cargo to the bottom structure. Preferably, the multi-mode ship further includes a bulk cargo transport system located within the cargo space. Preferably, the bulk cargo transport system includes a bulk cargo self loading portion comprising: at least one hopper located substantially adjacent to the side structure; at least one loading chute located within said cargo space; and at least one loading conveyor projecting into the cargo space in communication with the at least one hopper and the at least one loading chute. Preferably, the bulk cargo transport system further includes: a bulk cargo self off-loading portion comprising: at least one lower conveyor located substantially adjacent to the bottom structure; at least one upper conveyor located above said bottom structure; and at least one substantially vertical conveyor having a first end and a second end, the first end in communication with the at least one lower conveyor and the second end in communication with said at least one upper conveyor.

Preferably, the multi-mode ship further includes: a discharge side opening located in the side structure above the waterline of the multi-mode ship; wherein the at least one upper conveyor transports the bulk cargo from the at least one substantially vertical conveyor to the discharge side opening. Preferably, the multi-mode ship further includes: a longitudinal conveyor below the loading chute, wherein the longitudinal conveyor distributes bulk cargo prior to the bulk cargo gravity feeding through the plurality of substantially grated vehicle decks. Preferably, the multi-mode ship further includes: at least one liquid storage tank located adjacent to the bottom structure within the cargo space. Preferably, the at least one liquid storage tank further includes: a slope plate, the slope plate sloped to facilitate the gravity feeding of bulk cargo toward the at least one lower conveyor. Also preferably, the plurality of substantially grated vehicle decks are designed to accept vehicle lashing hooks "all over," obviating the need for separate lashing fittings.

Preferably, the conveyors are selected from the group consisting of screw-type conveyors, belt conveyors, bucket conveyors, pneumatic conveyors and pocket belt conveyors.

These and other features, aspects, and advantages of the present invention will become better understood with regard to the following description, appended claims, and accompanying drawings.

DETAILED DESCRIPTION OF THE DRAWINGS

The present multi-mode ship 100 comprises at least one multi-purpose vehicle deck and a bulk cargo transport system for loading, unloading, and transporting bulk cargoes, vehicles, standardized container cargoes, liquid cargoes or a mixture of these types of cargoes. The term bulk cargo and bulk cargoes includes grain, coal, pulverized coal, food stock, and any other materials that are capable of being loaded and off-loaded from the multi-mode ship 100.

Figure 1:
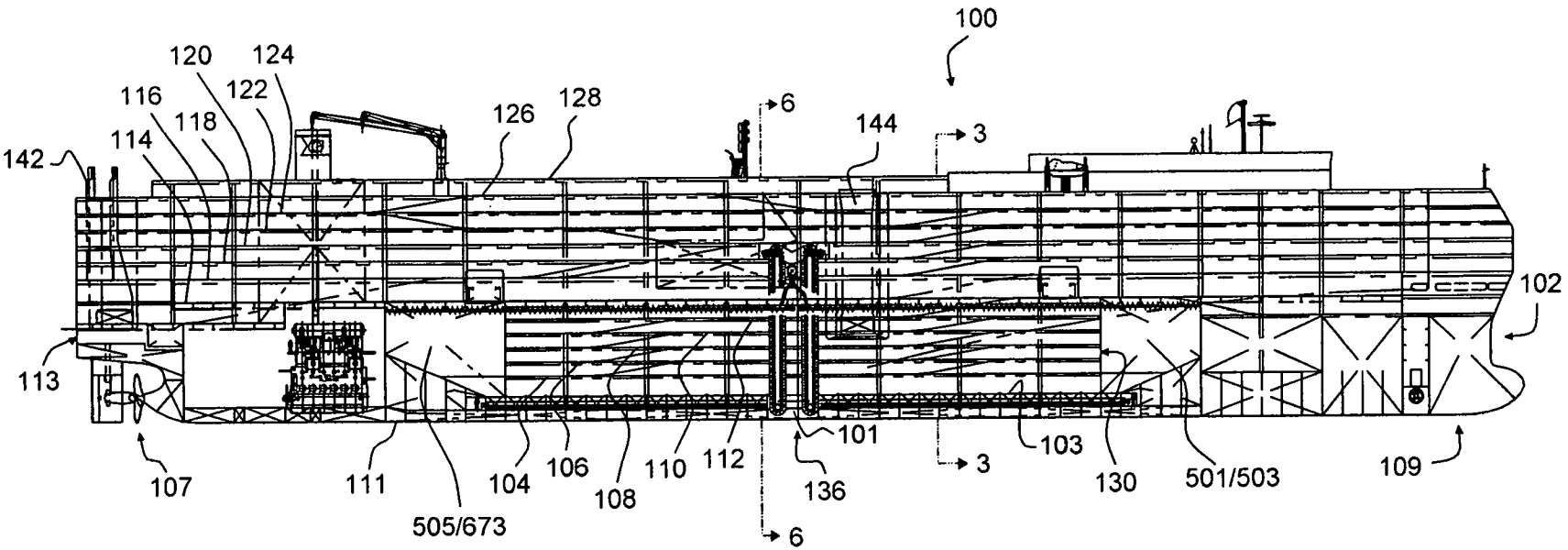
FIG. 1 illustrates a sectional view of the multi-mode ship of the present invention.

FIG. 1 illustrates the preferred embodiment 100 of the multi-mode ship design. The multi-mode ship 100 includes an inner bottom 101, a hull 102, and a hold bottom 103. Large ships generally have double skins with a reinforced torsion resisting box girder in the upper part, and below that there is often a passage box for internal traffic, cables, and channel and pipe lines. It goes without saying that the ship hull also comprises a bottom 111 and the bearing sides 113. These together constitute a self-supporting shell structure having a stern 107 and a bow 109. The multi-mode ship 100 also preferably includes vehicle decks 104, 106, 108, 110, 112, 114, 116, 118, 120, 122, 124, 126, and upper deck 128. In one aspect, the multi-mode ship includes a substantially solid upper deck and one or more intermediate, non-grating vehicle decks that are part of the load-bearing hull and the vehicle decks located within the defined cargo space are substantially grated. In this aspect, the upper deck and the one or more intermediate decks provide structural support and rigidity to the multi-mode ship. In another aspect, the multi-mode ship comprises essentially all vehicle decks that are grated and a solid upper deck that provides structural support and rigidity to the multi-mode ship 100. The present multi-mode ship can be configured with the desired solid support decks and grated vehicle decks as needed for a particular use. A novel aspect of the present multi-mode ship 100 is the vehicle deck configuration, thus the number of vehicle decks may vary with the ship size and intended use. For example, a multi-mode ship 100 may have two vehicle decks and an upper deck or may have five vehicle decks and an upper deck. In another aspect, the multi-mode ship 100 may have 12 vehicle decks and no upper deck or it may have 12 vehicle decks and an upper deck. The number of vehicle decks and the number of solid decks in the upper part of the hull may vary to fit the desired use of the multi-mode ship 100 without departing from the inventive concept.

The multi-mode ship 100 of the present invention further preferably includes a bulk cargo hold 130, liquid cargo tanks 137 and 139, and a bulk cargo transport system 136. As with the number of vehicle decks noted above, the multi-mode ship 100 may include the number of liquid cargo tanks appropriate for the size of the multi-mode ship 100, without departing from the inventive novelty of the present invention. Furthermore, the multi-mode ship 100 preferably includes other types of storage tanks, such as for fresh water, fuel, etc. (not shown) that are commonly known and used in the art. Preferably, the multi-mode ship 100 includes vehicle ramps 142 and 144 for loading and off-loading vehicles from the multi-mode ship 100. Preferably, vehicle ramp 144 and vehicle ramp 142 are capable of withstanding loads associated with the vehicles carried or used in the multi-mode ship 100.

Figure 2:
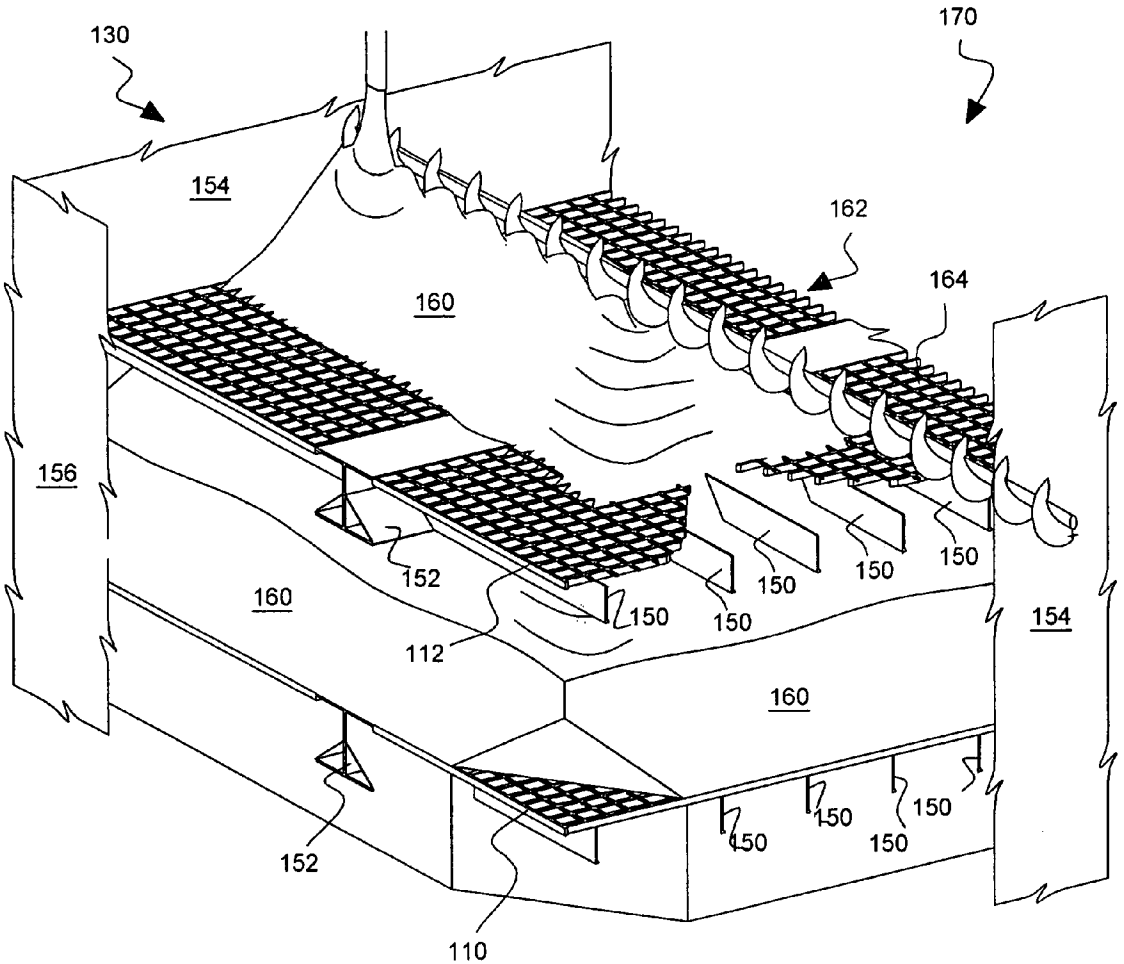
FIG. 2 illustrates a perspective view of a section of the bulk cargo hold and related vehicle decks of the present invention.

FIG. 2 illustrates a perspective view of a preferred embodiment 170 of a section of a bulk cargo hold 130 of the multi-mode ship 100. The multi-mode ship 100 may include one or several bulk cargo holds 130. The bulk cargo hold 130 depicted in FIG. 2 includes vehicle decks 110 and 112 which are preferably supported by at least one longitudinal deck support 150 and at least one transverse deck support 152. FIG. 2 further depicts a plurality of longitudinal deck supports 150 that are attached to a transverse bulkhead 154. Further, the transverse deck supports 152 are attached to the longitudinal bulkhead 156. The vehicle decks 110 and 112 are comprised of grating 162 that includes a plurality of openings 164. Bulk cargo 160 is depicted stored between and throughout the area defined by the vehicles decks 110 and 112, and further extending above vehicle deck 112. In one embodiment of the multi-mode ship 100, bulk cargo 160 is loaded onto the multi-mode ship 100 and flows downward through the grating of each vehicle deck, such as 110 and 112, to the hold bottom 103 where it begins to accumulate and piles upward through the vehicle decks above.

Figure 3:
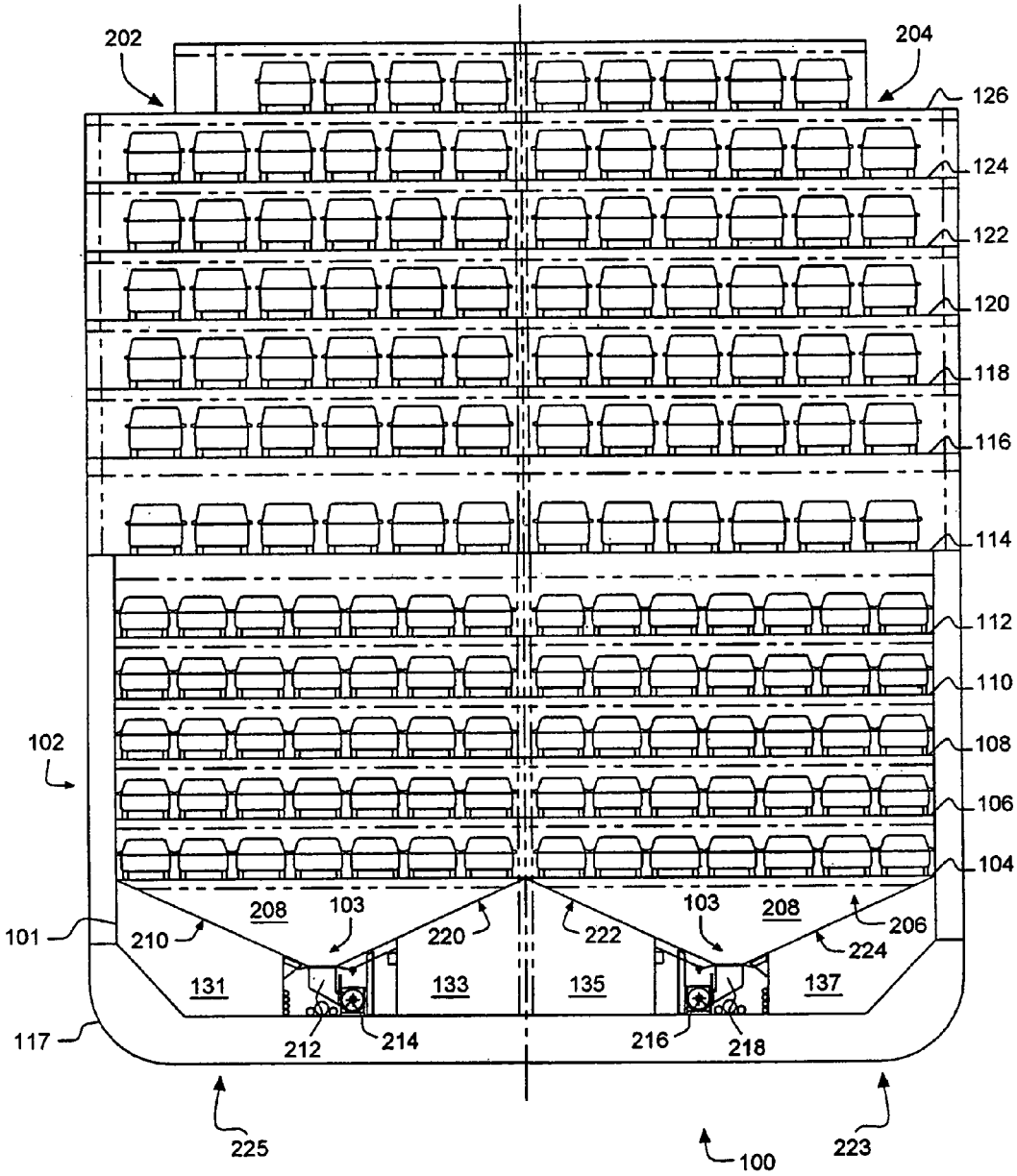
FIG. 3 illustrates a cross-sectional view of an embodiment of a multi-mode ship of FIG. 1 through the lines 3—3 of the present invention.

FIG. 3 illustrates a cross-section of an embodiment 202 of the multi-mode ship 100, having a hull 102 comprising an inner bottom 101 and an outer hull 117. The embodiment 202 further includes a starboard side 223 and a port side 225. Vehicles 206 and larger vehicles 204 are depicted stored on the vehicles decks 104–126. In this embodiment, a bulk cargo trough 208 located on the starboard side 223 and on the port side 225, is defined between the vehicle deck 104 and the hold bottom 103. The bulk cargo trough 208 is defined by slope plates 210, 220, 222, and 224 of the liquid cargo tanks 131, 133, 135, and 137, respectively. In this embodiment, the slope plates 210, 220, 222, and 224 are sloped and provide a quasi-funnel arrangement, resulting in the flow of bulk cargo 160 toward the middle of each bulk cargo trough 208 for collection by the lower longitudinal conveyor chutes 212 and 218 when being unloaded. The present multi-mode ship 100 preferably includes one or more different types of liquid cargo tanks, including liquid cargo tanks and liquid cargo deep tanks. Other types of tanks may be used with the present invention without departing from the novel concept herein disclosed. For example, the liquid cargo deep tanks 501, 503, 505, and 673 (shown in FIG. 17) may be preferably configured to permit carriage therein of either liquid cargo or bulk cargo. The liquid cargo deep tanks 501, 503, 505, and 673 (shown in FIG. 17) are preferably located forward and aft of the hold bottom 103.

In one aspect of the present multi-mode ship 100, the liquid cargo tanks 131, 133, 135, and 137 extend the distance of the hold bottom 103 and the slope plates 210, 220, 222, and 224 form the bulk cargo troughs 208 as shown in FIG. 3. Preferably the liquid cargo tanks 131, 133, 135, and 137 terminate at the liquid cargo deep tanks 501, 503, 505, and 673. In another aspect of the present multi-mode ship 100, the liquid cargo tanks 131, 133, 135, and 137 extend from the liquid cargo deep tanks 501, 503, 505, and 673 to the location of the lower transverse conveyors 226, 228, 232, and 230 (shown in FIG. 5).

Preferably, the longitudinal conveyor chutes 212 and 218 are connected to lower longitudinal conveyors 214 and 216, respectively. In another embodiment, the slope plates 210, 220, 222, and 224 are not sloped or are less sloped than depicted in FIG. 3.

Figure 4:
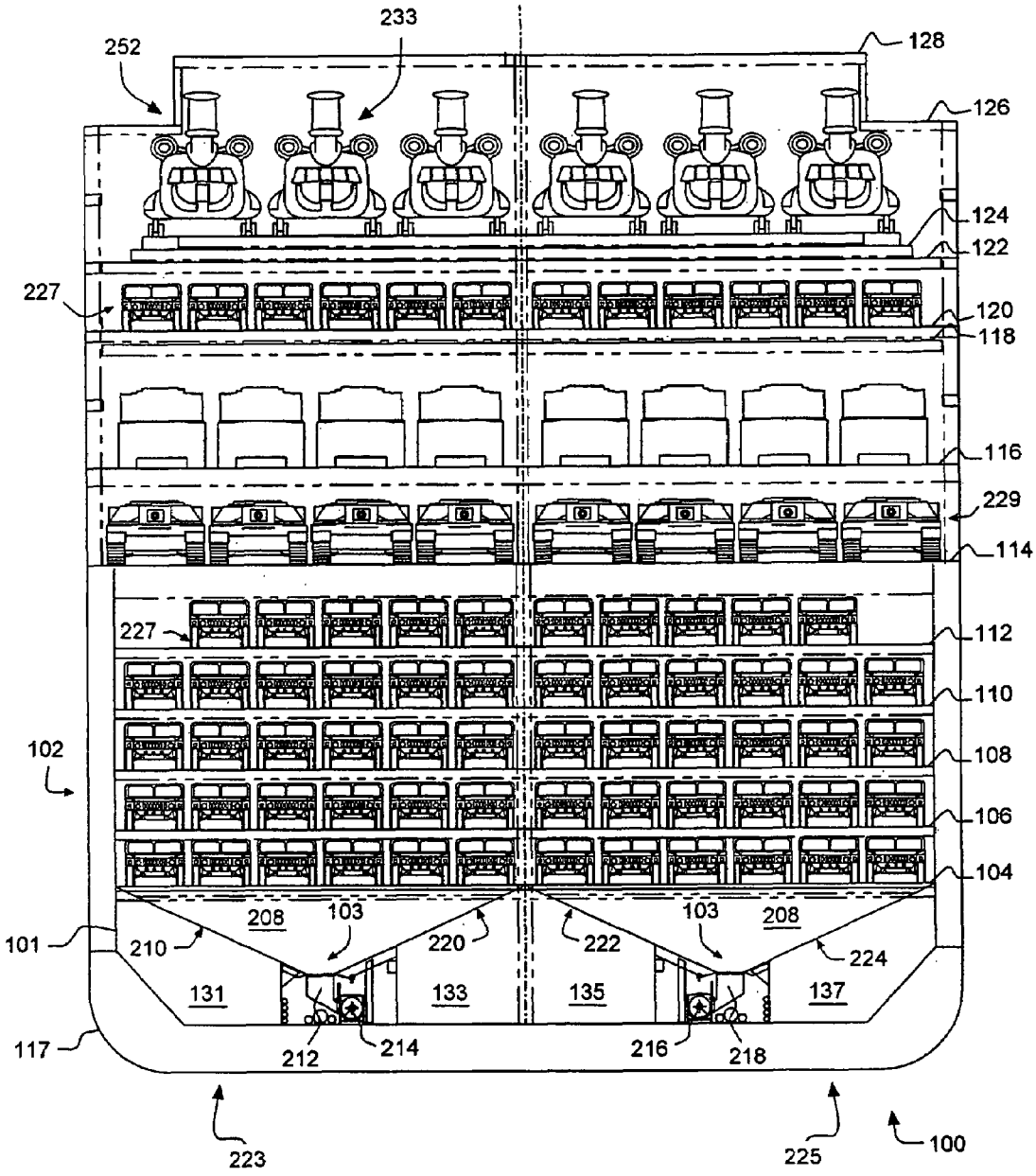
FIG. 4 illustrates a cross-sectional view of another embodiment of a multi-mode ship of FIG. 1 through the lines 3—3 of the present invention.

FIG. 4 illustrates a cross-section of another embodiment 252 of the multi-mode ship 100, having an arrangement of military vehicles, including a plurality of HMMV'S 227, Abrams Tanks 229, Bradley fighting vehicles 231, and helicopters 233. The multi-mode ship 100 provides for other arrangements of military vehicles by changing the vehicle decks height as shown in FIG. 4. Specifically, vehicle deck 124 is depicted lowered onto vehicle deck 122 to provide additional space between vehicle deck 124 and the upper deck 128. Also, in this embodiment, vehicle deck 118 can be raised to provide additional space between vehicle decks 118 and 116. In this embodiment of the multi-mode ship 100, some of the vehicle decks move upward and/or downward as described above. The multi-mode ship 100 also provides transport of a wide variety of military vehicles, including but not limited to, tanks, armored personnel carriers, HMMV'S, light trucks, and helicopters. In one aspect, the multi-mode ship 100 also transports military personnel.

Figure 5:
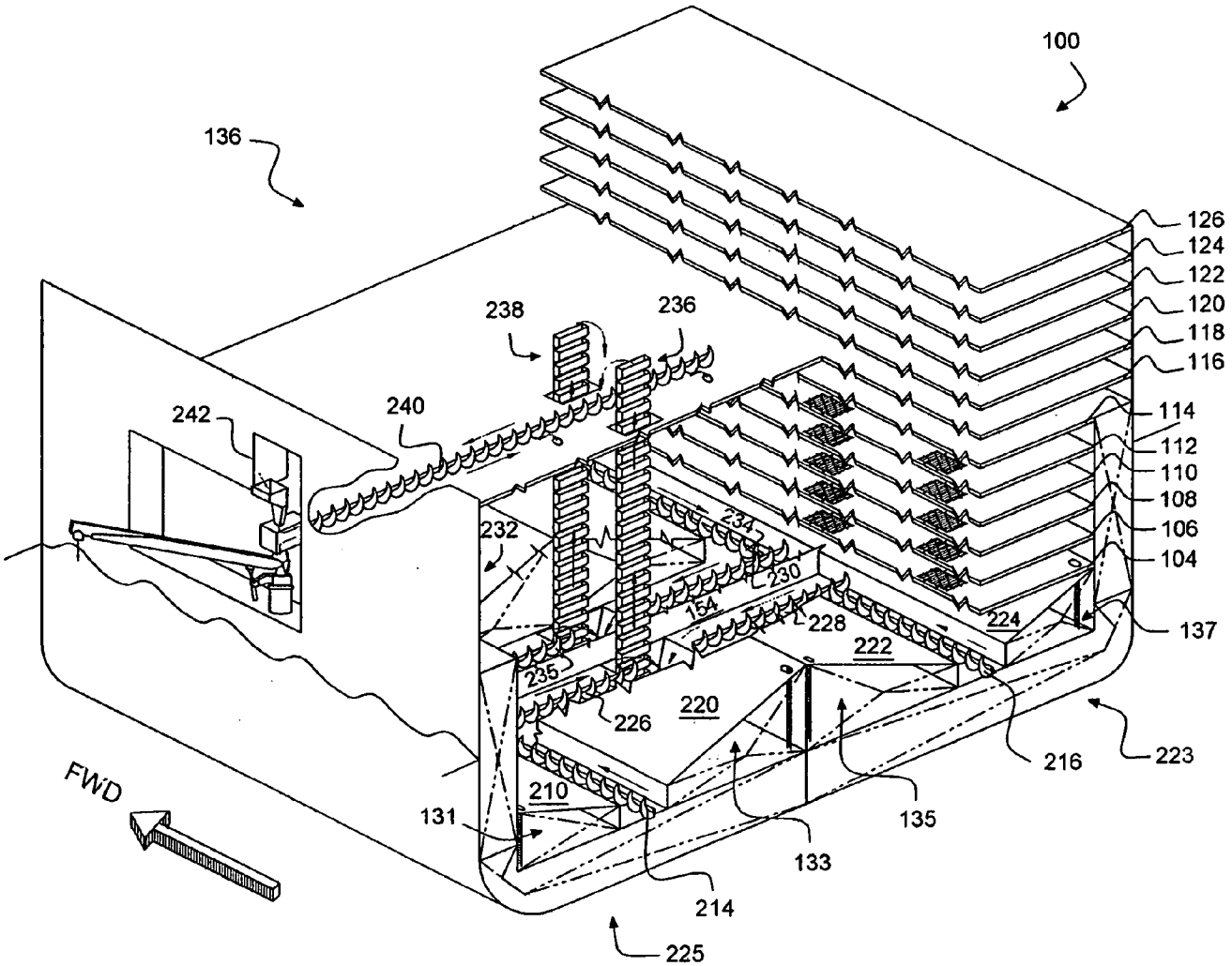
FIG. 5 illustrates a perspective view of a bulk cargo transport system of a multi-mode ship of the present invention.

FIG. 5 illustrates a perspective view of a bulk cargo transport system 136 of the multi-mode ship 100. Vehicle decks 104–126 have been cut-away to expose those parts associated with an embodiment of the bulk cargo transport system 136. In this embodiment, vehicle deck 116 is partially cut-away to show the relationship between one of the vehicle decks and the bulk cargo transport system 136. As can be seen in FIG. 5, in addition to the lower longitudinal conveyors 214 and 216, lower longitudinal conveyors 234 and 235 (shown in FIG. 18) run substantially longitudinally relative to the major axis of the hull 102 of the multi-mode ship 100. Preferably, the lower longitudinal conveyors 214, 216, 234, and 235 are located in the lower parts of the bulk cargo trough 208 formed by the slope plates 210, 220, 222, and 224 of the liquid cargo tanks 131, 133, 135, and 137. In addition to these conveyors, the bulk cargo system 136 of the multi-mode ship 100 further includes lower transverse conveyors 226, 228, 230, and 232 which run substantially transverse relative to the major axis of the hull 102 of the multi-mode ship 100. The bulk cargo system 136 preferably also includes vertical conveyors 236 and 238 that run upward through the levels of the vehicle decks 104, 106, 108, 110, 112, 114, and 116. In one aspect of the multi-mode ship 100, the vertical conveyors 236 and 238 may run upward between one or more bulkheads. In another aspect of the multi-mode ship 100, one of the vertical conveyors 236 and 238 may run upward through the levels of the vehicle decks and the other vertical conveyor may run upward between one or more bulkheads. In another aspect of the multi-mode ship 100, one or more vertical conveyors 236 and 238, which may or may not be enclosed in trunks, may be employed and located where desired within the cargo hold. In one aspect of the multi-mode ship 100 a watertight transverse bulkhead 154 is located between vertical conveyors 236 and 238. In another aspect of the multi-mode ship 100, a transverse bulkhead 154 is not located between vertical conveyors 236 and 238. The bulk cargo system 136 further includes an upper transverse conveyor 240 that is located substantially transverse to the major axis or centerline of the hull 102 of the multi-mode ship 100 and is preferably supported on or directly beneath the deck that constitutes the upper boundary of the bulk cargo hold. In another aspect, the upper transverse conveyor 240 may be located in orientation other than transverse to the major axis, or centerline of the hull 102 of the multi-mode ship 100. Further, the upper transverse conveyor 240 may be supported on or near any of the vehicle decks or non-vehicle decks of the multi-mode ship 100 without departing from the inventive concept disclosed herein. In one aspect of the multi-mode ship 100, the upper transverse conveyor 240 discharges bulk cargo from the multi-mode ship 100 through a discharge side opening 242.

Figure 6:
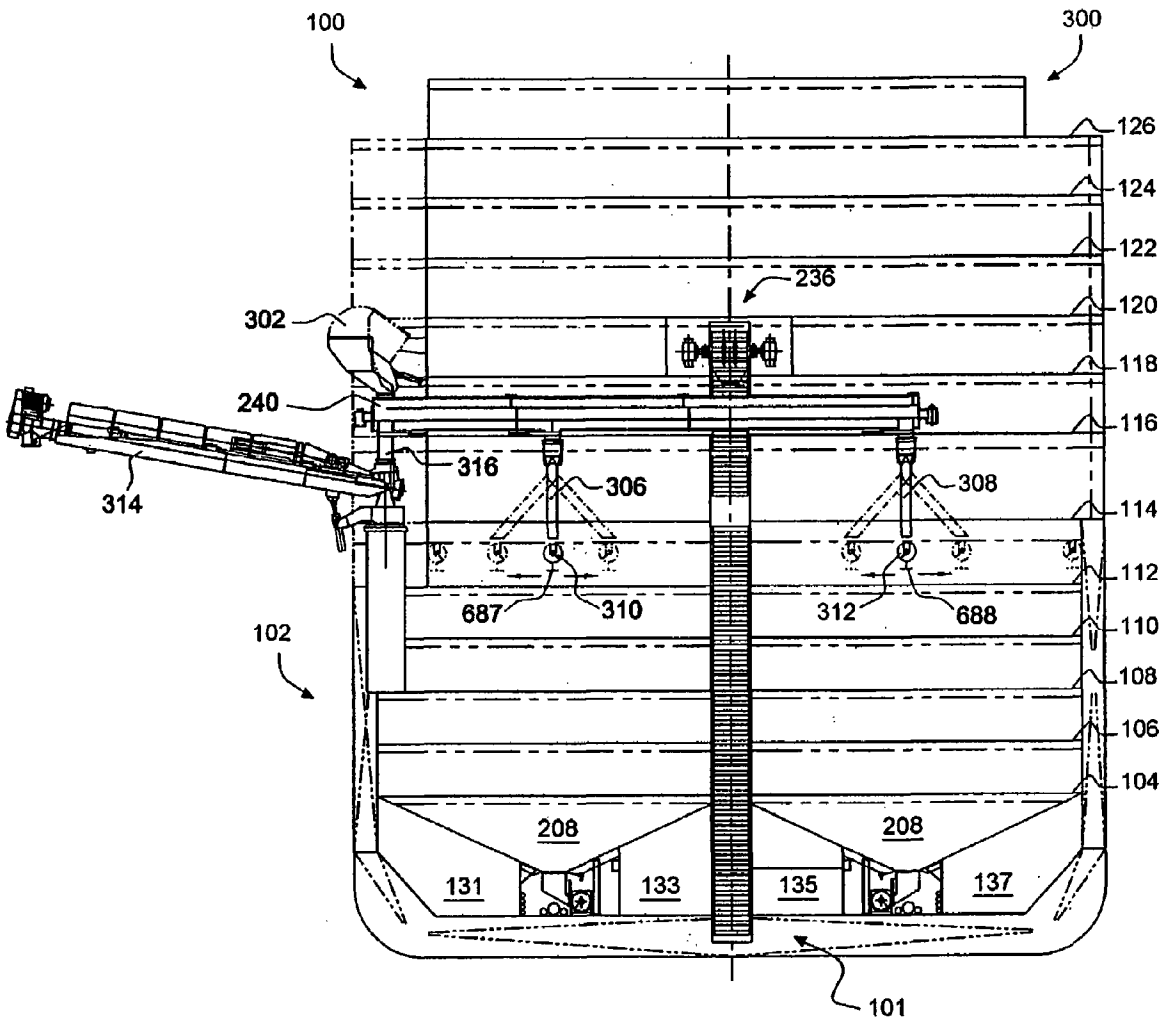
FIG. 6 illustrates a cross-sectional view of a bulk cargo transport system of a multi-mode ship of FIG. 1 through the lines 6—6 of the present invention.

FIG. 6 illustrates a cross-section view of an embodiment 300 of part of the bulk cargo system 136 of the multi-mode ship 100. The multi-mode ship 100 preferably includes an extendable and retractable hopper 302, an upper transverse conveyor 240, and loading chutes 306 and 308. In addition, the multi-mode ship 100 preferably includes loading longitudinal conveyors 310 and 312. In one aspect of the present invention, loading chute 306 directs bulk cargo 160 to loading longitudinal conveyor 310 and loading chute 308 directs bulk cargo 160 to loading longitudinal conveyor 312. Also preferably, loading longitudinal conveyors 310 and 312 are arranged to permit athwartship travel across the entire or partial breadth of the bulk cargo hold 130 on tracks or other guidance structure. At one or more locations within the bulk cargo hold 130, the loading longitudinal conveyors 310 and 312 distribute the bulk cargo 160 throughout the length of the hold. Preferably, in consonance with the fore and aft distribution of cargo by the longitudinal conveyors 310 and 312 are associated longitudinal conveyor cargo dispersers 687 and 688 that enhance cargo 160 distribution during cargo loading. The bulk cargo system 136 further includes a discharge boom 314. Cargo flows onto this discharge boom from the upper transverse conveyor, 240, via a conveyor downtube 316.

Figure 7:
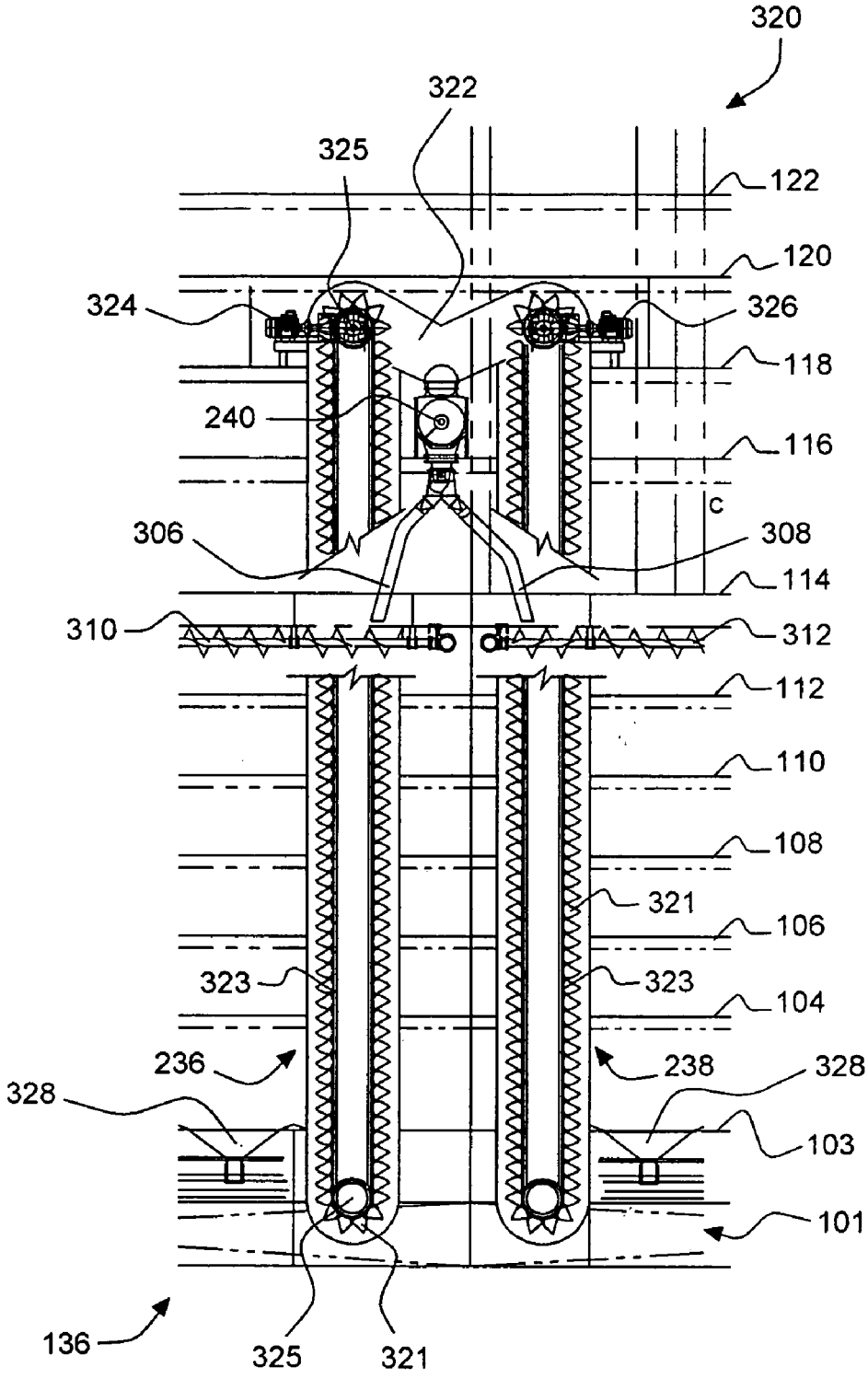
FIG. 7 illustrates a portion of a side view of a bulk cargo transport system of a multi-mode ship of FIG. 1 of the present invention.

FIG. 7 illustrates a side view of an embodiment 320 of part of the bulk cargo system 136 of the multi-mode ship 100. In one embodiment of the bulk cargo system 136, the vertical conveyors 236 and 238 comprise a plurality of scoops, pockets or buckets 321 that are connected to a track 323 that travels in a rotating motion to carry bulk cargo 160 from the inner bottom 101 and delivers the bulk cargo 160 to the top of the track's motion to dump the bulk cargo 160 into a vertical conveyor collector 322. In one aspect, the tracks 323 travel between sprockets 325 and are driven by conveyor motors 324 and 326.

As can be seen from FIG. 7, in one aspect of the bulk cargo system 136, the loading longitudinal conveyors 310 and 312 extend distally from the loading chutes 306 and 308 for transporting bulk cargo 160 distally from the loading chutes 306 and 308 when loading bulk cargo 160 into the multi-mode ship 100. Further, the bulk cargo system 136 also preferably includes collectors 328 located near the inner bottom 101 for funneling bulk cargo 160 toward the lower longitudinal conveyors 214, 216, 234, and 235.

Figure 8:
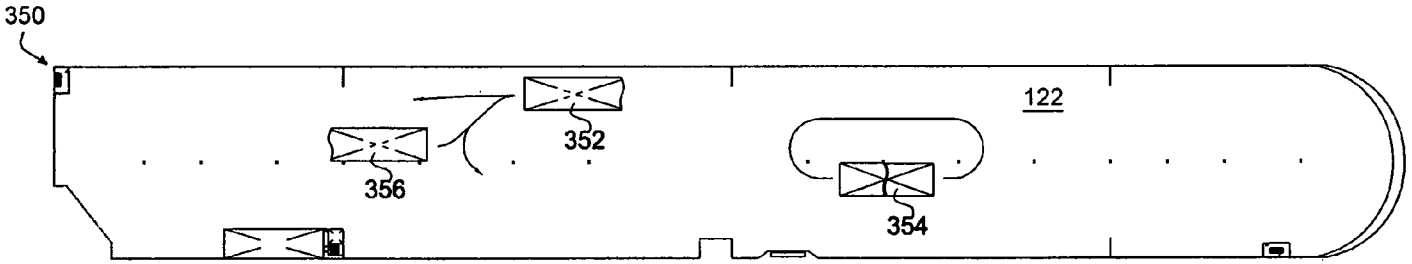
FIG. 8 illustrates a plan view of a vehicle deck of a multi-mode ship of FIG. 1 of the present invention.

FIG. 8 illustrates a floor plan view 350 of vehicle deck 122, which includes vehicle ramps 352, 354, and 356. These vehicle ramps 352, 354, and 356 are commonly known in the art and allow vehicles to drive to and from different vehicle decks on the multi-mode ship 100. As with all of the vehicle ramps described herein, they may facilitate vehicle travel between adjacent vehicle decks, such as vehicle deck 122 and 120, or they may facilitate vehicle travel between non-adjacent vehicle decks, such as 122 and 118. The vehicle ramps may also be used for the stowage of vehicles during a voyage. Further, the vehicle decks described herein are designed to provide support and access among the vehicle decks for the differing types of vehicles, such as military vehicles.

Figure 9:
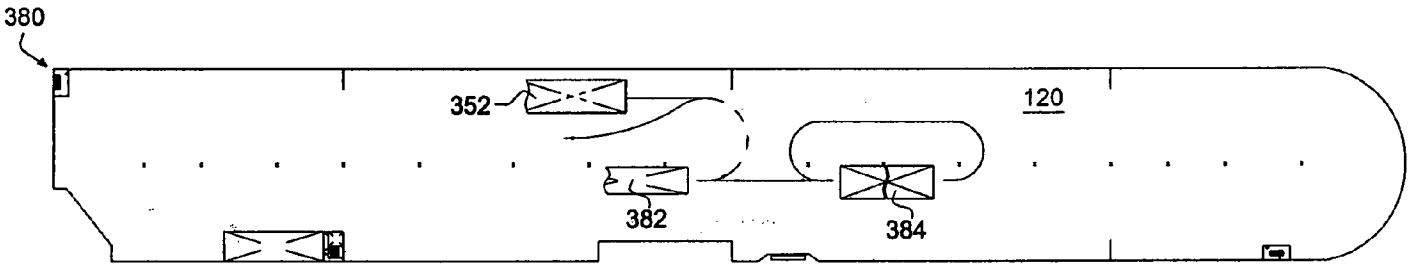
FIG. 9 illustrates a plan view of another vehicle deck of a multi-mode ship of FIG. 1 of the present invention.
Figure 10:
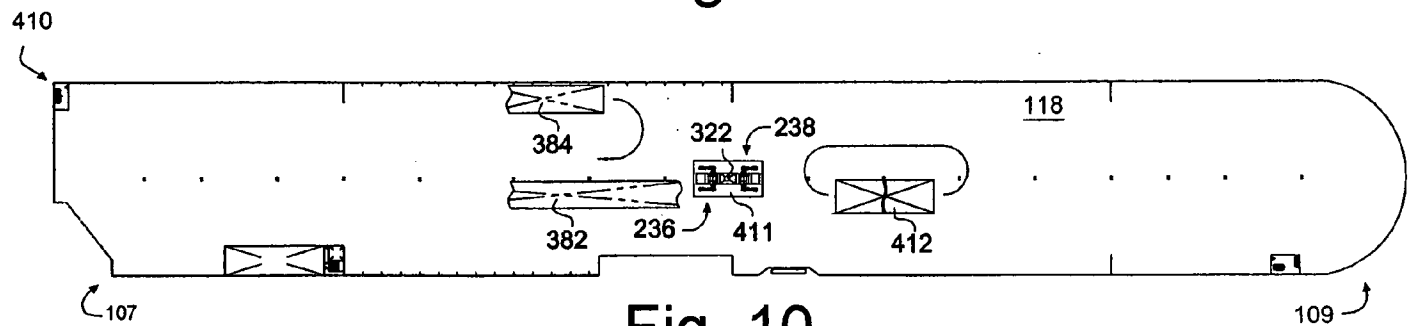
FIG. 10 illustrates a plan view of another vehicle deck of a multi-mode ship of FIG. 1 of the present invention.

FIG. 9 illustrates a floor plan view 380 of vehicle deck 120, which includes vehicle ramps 382 and 384. FIG. 10 illustrates a floor plan view 410 of vehicle deck 118, which includes vehicle ramp 412. In addition, the top of vertical conveyors 236 and 238 and vertical conveyor collector 322 are depicted within an opening 411 made in the vehicle deck 118. In one aspect of the multi-mode ship 100, the vertical conveyors 236 and 238 and the vertical conveyor collector 322 are located approximately midway between the bow 109 and the stern 107 of the multi-mode ship 100, however, in another aspect the vertical conveyors 236 and 238 and vertical conveyor collector 322 may be located in other locations, than amidships to facilitate off-loading of bulk cargo 160.

Figure 11:
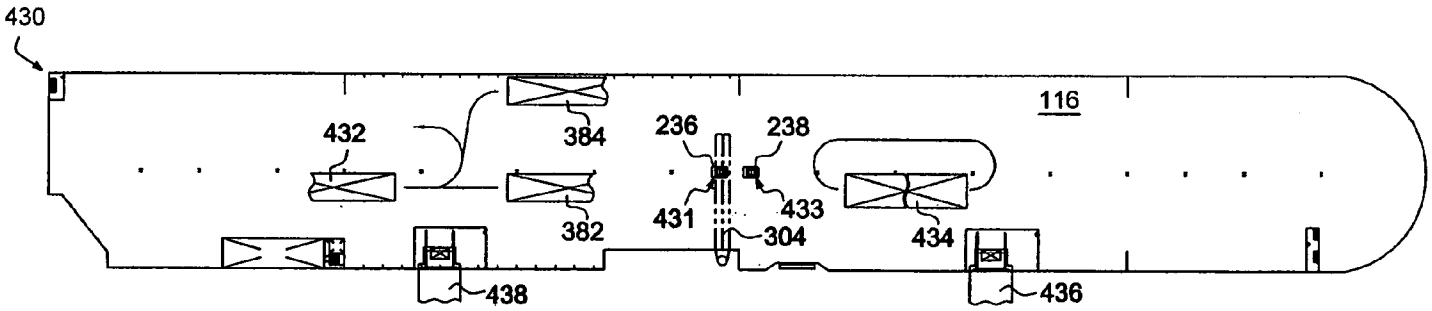
FIG. 11 illustrates a plan view of another vehicle deck of a multi-mode ship of FIG. 1 of the present invention.
Figure 12:
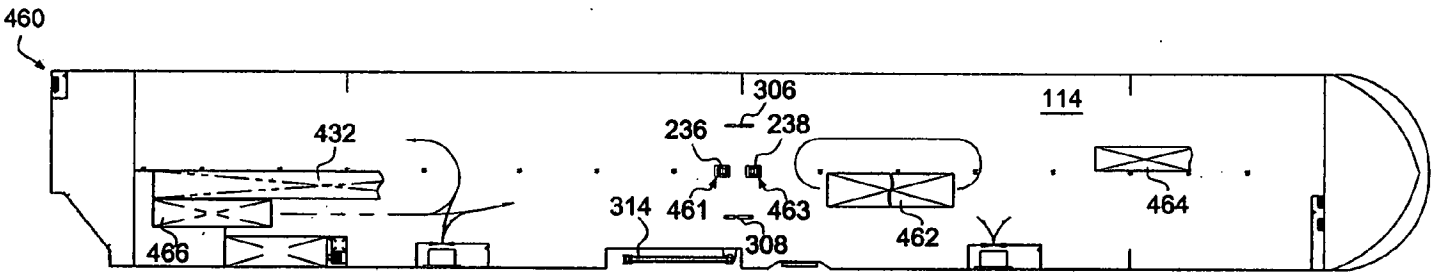
FIG. 12 illustrates a plan view of another vehicle deck of a multi-mode ship of FIG. 1 of the present invention.
Figure 13:
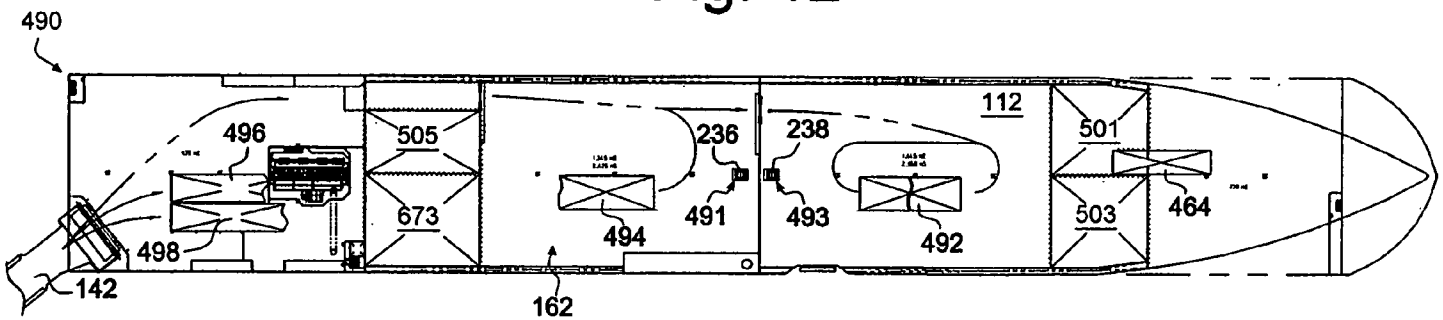
FIG. 13 illustrates a plan view of another vehicle deck of a multi-mode ship of FIG. 1 of the present invention.

FIG. 11 illustrates a floor plan view 430 of vehicle deck 116, which includes vehicle ramps 432 and 434. In addition, vertical conveyors 236 and 238 can be seen extending through openings 431 and 433 in vehicle deck 116. Preferably, the multi-mode ship 100 includes side doors 436 and 438 to facilitate loading cargo onto vehicle deck 116 or any other vehicle decks described herein. The side doors 436 and 438 are preferably configured for palletized cargo. FIG. 12 illustrates a floor plan view 460 of vehicle deck 114, which includes vehicle ramps 462, 464, and 466. Vertical conveyors 236 and 238 extend through the vehicle deck 114 through openings 461 and 463. FIG. 13 illustrates a floor plan view 490 of vehicle deck 112, which includes vehicle ramps 492, 494, 496, and 498. In addition to the liquid cargo tanks 131, 133, 135, 137, and 139 that are located within the boundaries of the slope plates and the inner bottom 101 as discussed above, the multi-mode ship 100 also preferably includes liquid cargo deep tanks 501, 503, 505 and 673. The outlines of these liquid cargo deep tanks 501, 503, 505, and 673 are seen through the grating 162 that covers a substantial part of the vehicle deck 112 and also vehicle decks 110, 108, 106, and 104. Vertical conveyors 236 and 238 extend through vehicle deck 112 through openings 491 and 493.

Figure 14:
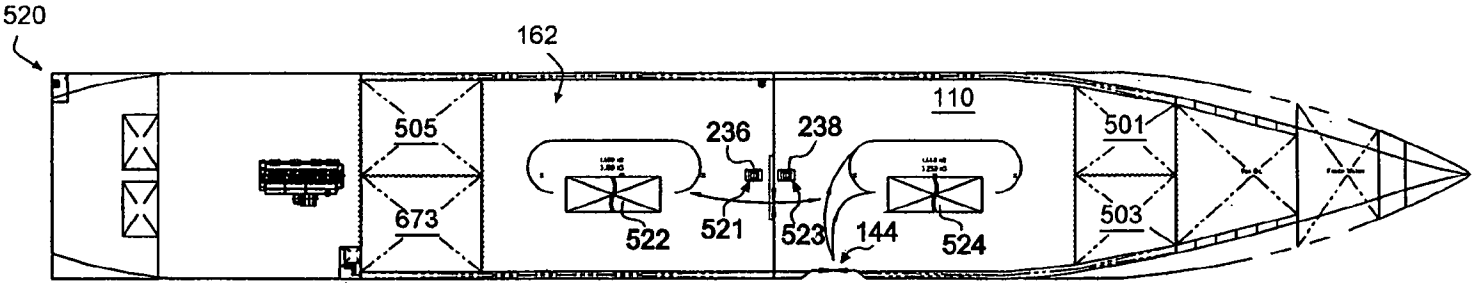
FIG. 14 illustrates a plan view of another vehicle deck of a multi-mode ship of FIG. 1 of the present invention.
Figure 15:
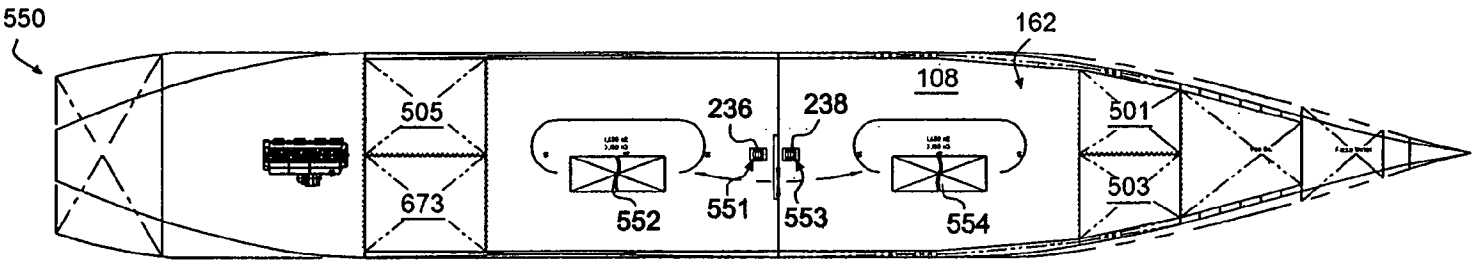
FIG. 15 illustrates a plan view of another vehicle deck of a multi-mode ship of FIG. 1 of the present invention.
Figure 16:
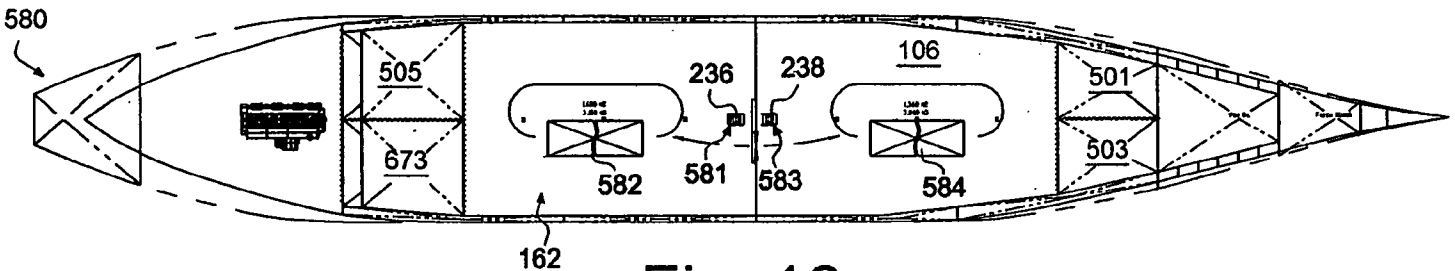
FIG. 16 illustrates a plan view of another vehicle deck of a multi-mode ship of FIG. 1 of the present invention.

FIG. 14 illustrates a floor plan view 520 of vehicle deck 110, which includes vehicle ramps 522 and 524. Vertical conveyors 236 and 238 extend through vehicle deck 110 through openings 521 and 523. FIG. 15 illustrates a floor plan view 550 of vehicle deck 108, which includes vehicle ramps 552 and 554. Vertical conveyors 236 and 238 extend through vehicle deck 110 through openings 551 and 553. FIG. 16 illustrates a floor plan view 580 of vehicle deck 106, which includes vehicle ramps 582 and 584. Vertical conveyors 236 and 238 extend through vehicle deck 106 through openings 581 and 583.

Figure 17:
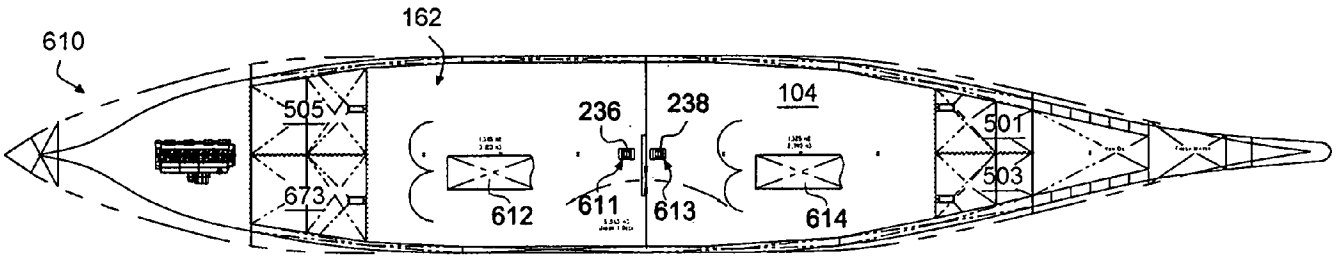
FIG. 17 illustrates a plan view of another vehicle deck of a multi-mode ship of FIG. 1 of the present invention.
Figure 18:
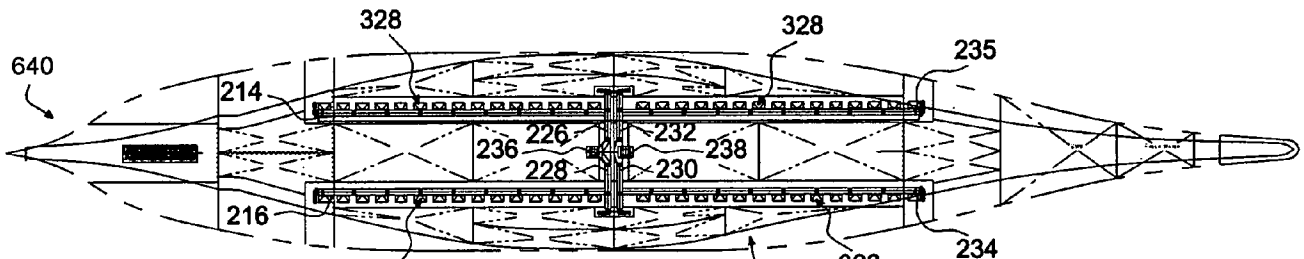
FIG. 18 illustrates a plan view of a hold bottom of a multi-mode ship of FIG. 1 of the present invention.
Figure 19:
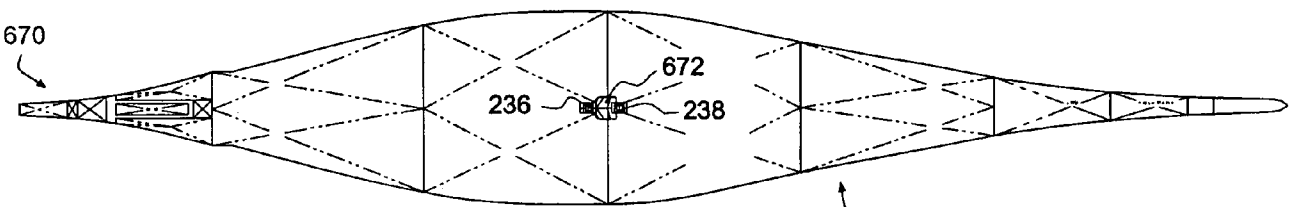
FIG. 19 illustrates a plan view of an inner bottom of a multi-mode ship of FIG. 1 of the present invention.

FIG. 17 illustrates a floor plan view 610 of vehicle deck 104, which includes vehicle ramps 612 and 614. Vertical conveyors 236 and 238 extend through vehicle deck 104 through openings 611 and 613. FIG. 18 illustrates a floor plan view 640 of hold bottom 103. As can be seen in this embodiment of the multi-mode ship 100, lower longitudinal conveyors 214, 216, 234, and 235 are arranged so as to come into contact with the bulk cargo 160 as it rests on the hold bottom 103. A plurality of collectors 328 are positioned along the lower longitudinal conveyors 214, 216, 234, and 235. FIG. 19 illustrates a floor plan view 670 of the inner bottom 101 of the multi-mode ship 100. The inner bottom 101 preferably includes the lower ends of vertical conveyors 236 and 238 and vertical conveyor feed bins 672.

Figure 20:
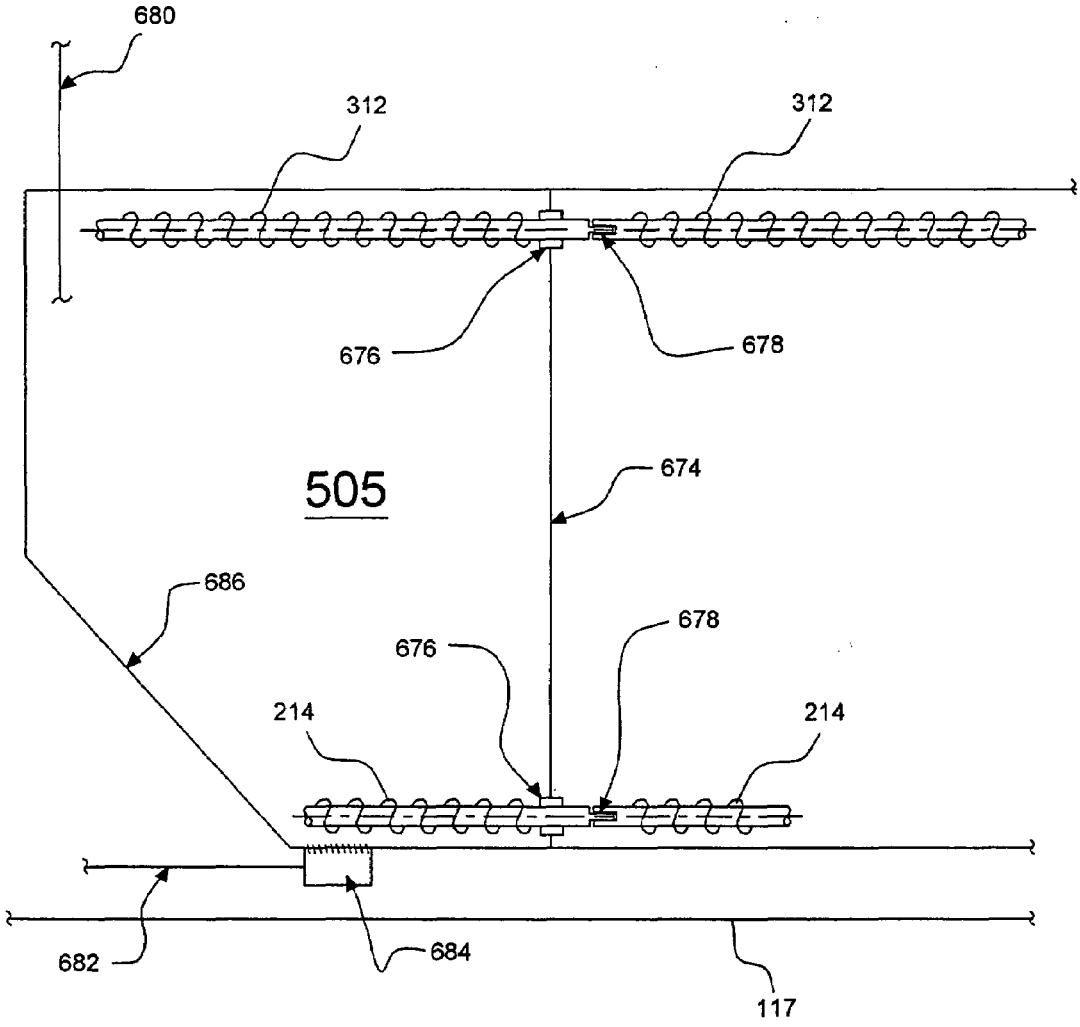
FIG. 20 illustrates a cross-section view of a liquid cargo deep tank of a multi-mode ship of the present invention.

FIG. 20 illustrates a cross-section view of liquid cargo deep tank 505. The description described herein with regard to liquid cargo deep tank 505 is applicable to liquid cargo deep tanks 503, 505, and 673 as well, therefore the following description will not be repeated with respect to liquid cargo deep tanks 503, 505, and 673. As is shown in FIG. 20, liquid cargo deep tank 505 preferably includes loading longitudinal conveyor 312 that is located near the top of the liquid cargo deep tank 505 for moving or distributing bulk cargo 160 within the tank during bulk cargo loading operations. In addition, the liquid cargo deep tank 505 also includes a lower longitudinal conveyor 214 located near the bottom of liquid cargo deep tank 505 for moving the bulk cargo toward lower transverse conveyor 226 during off-loading operations. In one aspect of the present multi-mode ship 100, the liquid cargo deep tank may include a bulkhead 674, in which case conveyor passageways are formed or shaped in the bulkhead 674 to allow the conveyors, such as loading longitudinal conveyor 312 and lower longitudinal conveyor 214 to pass through the bulkhead 674. Where such conveyor passageways exist, preferably a mechanical seals or closure plates 676 may be used to create a liquid-tight seal to prevent liquid cargo from seeping between the bulkheads when the liquid cargo is stored in the deep tanks 501, 503, 505, and 673. In addition, a sleeve-type mechanical disconnect, such as a clutch 678, may be used to engage/disengage sections of the loading longitudinal conveyor 312 and the lower longitudinal conveyor 214.

Liquid cargo deep tank 505 further includes a liquid cargo inlet line 680, a liquid cargo outlet line 682, and one or more liquid cargo drain wells 684 for loading and unloading liquid cargo in liquid cargo deep tank 505. The inlet 680, outlet 682, and liquid cargo drain well 684 include piping, pumps, and related connections commonly known to facilitate the handling of liquid materials. In addition, manifolds may be used to connect the liquid cargo deep tanks 501, 503, 505, and 673 together to facilitate loading and unloading of liquid cargo from the multi-mode ship 100 to and from on-shore or off-shore loading/storage facilities. Further, liquid cargo deep tank 505, as with all liquid cargo deep tanks, may also include slope plate 686 to facilitate the gravity feeding of bulk cargo toward the lower longitudinal conveyor 214.

In one aspect of the multi-mode ship 100, the slope plates 210, 220, 222, and 224 within the bulk cargo hold 130 continue into the liquid cargo deep tanks 501, 503, 505, and 673 and intersect with their respective deep tank slope plates.

A novel aspect of the multi-mode ship 100 is the vehicle deck design and configuration that allows for efficient loading, carriage and off-loading of vehicles, bulk cargo, liquid cargo and combinations of them. The vehicle decks, such as 112–104, are made of grating 162 suitable, when the multi-mode ship 100 is used to load/offload and transport vehicles, such as vehicles 206, larger vehicles 208, and HMMV'S 227, while allowing bulk cargo 160 to flow through the openings 164 when the multi-mode ship 100 is used to load/offload and transport bulk cargo 160. The grating 162 of the vehicle decks can be made of steel or other metal or compositions of metals suitable for this purpose. The openings 164 are designed and sized to allow vehicle travel on top of the vehicle decks while allowing unrestricted flow of bulk cargo 160 through the openings 164 of the grating 162 of the vehicle decks. The vehicle decks are designed and attached to transverse bulkheads 154 and longitudinal bulkheads 156 to provide necessary deck areas and strengths for transporting all of these types of cargoes. Further, some vehicle decks, such as vehicle deck 116, may be made with substantially non-grating composition. This provides support for the bulk cargo 160 after the vertical conveyors 236 and 238 have raised the bulk cargo 160 to the top of the travel of the conveyors 236 and 238 and have dumped the bulk cargo 160, via the vertical conveyor collector 322, onto the loading longitudinal conveyors, 310 and 312. Preferably, grating 162 is a heavy weld bar steel grating. Preferably, the bearing bars have a depth of 2.5 inches (63.5 mm) and the twisted steel cross bars a diameter of approximately ⅜ inches (9.5 mm). The rectangular shaped openings 164 preferably have a nominal size of 4 inches (101 mm) by 2-⅜ inches (60.3 mm). In another aspect of the present multi-mode ship 100 will include vehicle decks comprised of solid rolled plate having a thickness that is suitable for the intended vehicle, pallet, and/or helicopter loads. The plating coating system will be selected on the basis of wear resistance, skid resistance, and corrosion protection. Preferably skid resistance of the coating system will not injure vehicle tires when the vehicles are in motion including at constant velocities, acceleration, and deceleration. Preferably skid resistance will not impede or cause personal injury to those persons securing and un-securing the vehicle or aircraft lashings. Also preferably the skid protection will not result in undue damage to the knee protectors of those persons securing and un-securing the vehicle or aircraft lashings. Also preferably, the grating 162 is coated with material selected on the basis of wear resistance, skid resistance, corrosion protection, and compatibility with the intended bulk cargoes. Preferably the skid resistance of the grating coating system is supplemented by the supply of gratings that are serrated. Preferably the serrations will not impede or cause personal injury to those persons securing and un-securing the vehicle or aircraft lashings. Also preferably the serrations will not result in undue damage to the knee protectors of those persons securing and unsecuring the vehicle or aircraft lashings. Preferably, the grating 162 will be sized and arranged so that the vehicle decks will also constitute a multiplicity of points for attachment of vehicle lashings.

For loading and off-loading helicopters from the multi-mode ship 100, dedicated or non-dedicated rotary cranes working from the weatherdeck are used to transport helicopters on and off the multi-mode ship 100. A platform type elevator is preferably used to transport the helicopters from the weatherdeck to their stowage position on an enclosed deck, 122. In addition helicopters may be transported from the weatherdeck to their stowage position using a lift that may be cable operated by hydraulic cylinders acting in consonance with pulleys to obtain the required mechanical advantage and to work within the height limitations of the system.

Another novel aspect of the multi-mode ship 100 is the bulk cargo transport system which provides an efficient means for loading and off-loading bulk cargo. In one aspect of the multi-mode ship 100, the lower longitudinal conveyors 214, 216, 234, and 235; the lower transverse conveyors 226, 228, 230, and 232; the upper transverse conveyor 240; and the loading longitudinal conveyors 310 and 312 are screw-type conveyors. They operate by being rotated about their major axis by motors (not shown) to feed the bulk cargo 160 in one direction or another. For example, in an operation for off-loading bulk cargo 160, the lower longitudinal conveyors 214, 216, 234, and 235 would rotate in a direction to feed the bulk cargo 160 toward the lower transverse conveyors 226, 228, 230, and 232, which in turn would rotate in a direction to feed the bulk cargo 160 toward the vertical conveyor feed bin 672 in the inner bottom 101 of the multi-mode ship 100. Preferably the longitudinal loading conveyors 310 and 312 are capable, for cargo trimming purposes, to move to a plurality of athwartship locations within the bulk cargo hold 130. Also, the longitudinal loading conveyors 310 and 312 are arranged so that they may be moved to the outboard sides of the hold in order not to interfere with vehicle movement or stowage requiring the full clear height available in the hold.

The present invention is not limited by the number of conveyors described herein. The multi-mode ship 100 may employ any number of conveyors, horizontal, vertical, longitudinal, transverse, or otherwise to perform the loading and off-loading bulk cargo 160 operation.

In another example, during loading of bulk cargo 160, these conveyors rotate in the reverse direction to feed the bulk cargo distally from the center of the multi-mode ship 100. All of these conveyors work simultaneously or sequentially depending on the needs of the operation. In addition, during loading of bulk cargo 160, the loading longitudinal conveyors 310 and 312 rotate to disperse the bulk cargo distally from the loading chutes 306 and 308.

Other off-loading systems can be employed to off-load bulk cargo 160 from the multi-mode ship 100. For example, in another aspect of the multi-mode ship 100, gantry grabs are used to off-load the bulk cargo 160 from the ship's gantry with rails that are extended beyond the side of the ship. In yet another aspect of the multi-mode ship 100, a portable vacuum off-loading system may be employed with portable hoses to work the bulk cargo hold 130 to discharge bulk cargo 160 to a nearby pier or lighters. Further, in another aspect of the multi-mode ship 100, a vacuum system may be employed to off-load bulk cargo 160 through fixed ducting to minimize the extent of portable hoses.

In addition to these aspects mentioned above, the multi-mode ship 100 may utilize other off-loading systems such as an in-hold belt/gate conveyor with vertical "C" belt, an in-hold belt/gate conveyor with vertical pocket belt, an in-hold moving hole feeder with vertical pocket belt, screw conveyors with vertical pocket belt, and screw conveyors associated with other horizontal and vertical systems. All of these systems require a means to transport the grain or bulk cargo from the hold bottom 103 to the "top" of the vertical unloaders to the side of the ship and then to the pier or lighter. For any one of these systems there are common alternatives including belt conveyors, screw conveyors, and pneumatic conveyors.

Another aspect of the multi-mode ship 100, is the shape or slope of the slope plates 210, 220, 222, and 224. As can be seen from FIG. 5, these sloping slope plates funnel the bulk cargo 160 toward the lower longitudinal conveyors 214 and 216. Though not depicted, liquid cargo deep tanks 501, 503, 505, and 673 have similarly designed or sloped surfaces to act as funnels to push or feed the bulk cargo 160 toward lower longitudinal conveyors 234 and 235. Furthermore, the ship's hold bottom 103 is preferably v-shaped to further provide a funneling action to push the bulk cargo 160 toward a central point or conveyor for collection and off-loading. The discharge boom 314 may also be any mechanical device that pushes or feeds bulk cargo 160 from the multi-mode ship 100 to a pier or lighter.

The liquid cargo tanks 131, 133, 135, 137 and the liquid cargo deep tanks 501, 503, 505, and 673 are sealed to prevent spillage into the hold bottom 103. Preferably, the liquid cargo tanks 131, 133, 135, 137 and the liquid cargo deep tanks 501, 503, 505, and 673 are vented to equalize pressure within the liquid cargo tanks during use. Closed and open gauging systems may be used to gauge the volume of liquids contained in the liquid cargo tanks 131, 133, 135, 137 and the liquid cargo deep tanks 501, 503, 505, and 673. The liquid cargo tanks 131, 133, 135, 137 and the liquid cargo deep tanks 501, 503, 505, and 673 may be either coated or constructed of stainless steel and are preferably fitted with tank washing machines. Bulk cargo is loaded into the liquid cargo deep tanks 501, 503, 505 and 673 by an extension of the loading longitudinal conveyors, 310 and 312, into the liquid cargo deep tanks 501, 503, 505, and 673. Suitable mechanical clutches and closure plates will be provided when liquid cargo is transported. Bulk cargo is off loaded from the liquid cargo deep tanks by an extension of the lower longitudinal conveyors, 214, 216, 234, and 235 into the liquid cargo deep tanks 501, 503, 505, and 673. Suitable mechanical clutches and closure plates will be provided when liquid cargo is transported.

The multi-mode ship 100 also preferably includes a dedicated ventilation system for the bulk cargo hold 130 with filters and closure plates to prevent contamination of the ventilation system for the upper vehicle decks, such as vehicle decks 114–126. Also, the ventilation system prevents short circuiting of air (i.e., re-ingestion of exhausted air) above the weatherdeck. Preferably, since both intake and outlet ventilation terminals will be located on the weather deck, care will be taken to prevent the outlet air flow (exhaust) from being ingested by the inlet terminals. This is accomplished by the judicious placement, orientation and design of the respective terminals. In addition, when the liquid cargo tanks are used to store bulk cargo, the same considerations with respect to cargo hold ventilation are applicable, i.e., filtering, segregation, and the prevention of short circuiting above the weather deck.

Cleaning procedures when transporting bulk cargo 160 are the same as those for the bulk cargo hold 130. Fixed tank cleaning machines are used for cleaning the tanks after the transport of liquid cargoes. The multi-mode ship 100 design provides that after the bulk cargo 160 discharge from the multi-mode ship 100, the bulk cargo hold 130 is completely clean and free of all bulk cargo 160 particulates. This is achieved by a combination of fixed or portable vacuums and blowers working together with hand wiping. The bulk cargo hold cleaning procedure and methods will be based on the type of cargo that has been transported and the extent of residual cargo. Ideally vacuuming of the hold will be sufficient, but in certain cases it may be advantageous to blow the cargo into central locations where it can then be vacuumed. Also there may be instances where vacuuming is not sufficient and wet and/or dry wipes are required after all of the vacuuming is completed.

In addition to the aforementioned aspects and embodiments, the present multi-mode ship 100 further includes methods for loading, off-loading, and storing bulk cargo 160. In one embodiment of the present invention for loading of bulk cargo 160 aboard the multi-mode ship 100, vehicle decks 104–112 are cleared of all vehicles, if any are present. The hopper 302 is placed in proximity to an on-shore or off-shore loading supply and bulk cargo is transported from the loading supply to the hopper 302 by gravity loading of the multi-mode ship 100 utilizing on-shore, off-shore, or onboard loading equipment. In addition, a combination of sloped chutes may be used in addition to, or in place of, the hopper 302. Furthermore, this bulk cargo 160 loading may be performed by a portable vacuum equipment, fixed vacuum equipment, extendable belt conveyor and hopper, and/or with a hopper, chute, and horizontal screw or belt type conveyors. The hopper 302 then feeds the bulk cargo 160, by gravity or otherwise, to the upper transverse conveyor 240 that transports the bulk cargo 160 to the loading chutes 306 and 308. In one embodiment of the bulk cargo transport system 136, the bulk cargo 160 then exits the bottom of the loading chutes 306 and 308 and falls by gravity toward the loading longitudinal conveyors 310 and 312. These loading longitudinal conveyors 310 and 312, which may be fitted with longitudinal conveyor cargo dispensers 687 and 688, then distribute the bulk cargo 160 distally from the loading chutes 306 and 308, where the bulk cargo 160 then falls by gravity through the grating 162 of vehicle decks 104–112 toward the hold bottom 103. This process continues until the bulk cargo 160 has reached the loading limit of the multi-mode ship 100 or otherwise desired. In one aspect of the multi-mode ship 100, the bulk cargo 100 piles upward from the hold bottom 103 and fills the area defined between the hold bottom 103 and vehicle deck 114, including all vehicle decks in between.

Once the multi-mode ship 100 has reached her destination and is ready to be off-loaded, the following process is employed. Vertical conveyors 236 and 238 are operated to move the bulk cargo 160 from the vertical conveyor feed bins 672 to the level of vehicle deck 116 which provides support for the upper transverse conveyor 240 and the associated vertical conveyor collector 322. To move the bulk cargo 160 from the vertical conveyor feed bin 672, the vertical conveyors 236 and 238 are comprised of a plurality of buckets 321, pockets or containers that are attached to tracks 323 that move in an upward motion. During operation, the buckets 321 move unimpeded through the vehicle decks through openings 411, 431, 433, 461, 463, 491, 493, 521, 523, 551, 553, 581, and 583 to a top travel position where the buckets 321 dump the bulk cargo 160 onto the upper transverse conveyor 240 via the vertical conveyor collector 322.

The upper transverse conveyor 240 is operated to feed the bulk cargo 160 toward the discharge side opening 242, where it exits the discharge side opening and falls by gravity through the conveyor downtube 316 toward the discharge boom 314 where it is transported to off-shore or on-shore storage. To transport the bulk cargo 160 from the distal ends of the multi-mode ship 100 to the vertical conveyor feed bin 672, the lower longitudinal conveyors 214, 216, 234, and 235 are operated to feed the bulk cargo 160 from the distal ends of the bulk cargo hold 130 to the lower transverse conveyors 226, 228, 230, and 232, which are in turn operated to feed the bulk cargo 160 toward the vertical conveyor feed bin 672. During this operation, bulk cargo 160 gravity feeds through the plurality of lower longitudinal conveyor chutes 212 and 218.

In addition to the aforementioned aspects and embodiments, the present multi-mode ship 100 further includes methods for loading, off-loading, and storing vehicles 206 and larger vehicles 204. In one embodiment of the present invention, when loading vehicles 206 and larger vehicles 204, the multi-mode ship 100 is cleared of all bulk cargo 160, if any is present. Vehicle ramp 142 is used to drive vehicles 206 and larger vehicles 204 onto the multi-mode ship 100 and vehicle ramps 494, 492, 464, 432, 434, 382, 384, 522, 524, 552, 554, 582, 584, 612, 614, 356, 354, and 352 are used to drive the vehicles 206 and larger vehicles 204 to a storage space located on one of the vehicle decks 104–126 of the multi-mode ship 100. Once the multi-mode ship 100 has reached its destination, the above operation can be performed in reverse to unload the vehicles 206 and the larger vehicles 204.

As an example of the vehicle deck areas and strengths of the multi-mode ship 100, the following examples are provided.

EXAMPLE 1

Military Configuration with Bulk Cargo Back Haul

In one aspect of the multi-mode ship 100 the deck configuration has nine decks available for carriage of military equipment. As mentioned above, the multi-mode ship 100 has vehicle decks that are vertically moveable, so in this example vehicle deck 124 is lowered onto vehicle deck 122 and vehicle deck 118 is raised to be adjacent to vehicle deck 120. In this configuration, 72,000 $ft^2$ of vehicle deck space is available with a clear height of 20.3 ft with a preferred deck strength of 200 pounds per square foot (psf). In addition, there also exists 69,500 $ft^2$ of vehicle deck space with a clear height of 13.5 ft. with a preferred deck strength of 350 psf. Further, there exists 60,000 $ft^2$ of vehicle deck space with a clear height of 9.5 ft. with a preferred deck strength of 550 psf, for a total of 201,500 $ft^2$ of vehicle deck space for special defense vehicles, such as Abrams tanks 229, Bradley fighting vehicles 231, and helicopters 233. Also, there exists 166,000 $ft^2$ of vehicle deck space with a clear height of 6.1 ft. with a preferred deck strength of 50–70 psf for HMMV'S 227 and light jeeps/pickup trucks.

The multi-mode ship 100 also transports approximately 30,000 metric tons of bulk cargo 160 as a back-haul cargo. The preferred minimum bulk cargo 160 off-loading rate is 2,000 metric tons per hour.

EXAMPLE 2

Commercial Configuration with Bulk Cargo Back Haul

In a commercial aspect of the multi-mode ship 100, the deck configuration has twelve decks for commercial vehicle service. In this example, the multi-mode ship 100 transports a minimum of 6,400 passenger vehicles, or a mix of various passenger, sport utility, and light commercial vehicles; Deck strengths are the same as in Example 1. The multi-mode ship 100 also transports approximately 30,000 metric tons of bulk cargo 160 as a back-haul cargo. The minimum bulk cargo 160 off-loading rate is 2,000 metric tons per hour.

Although there has been described what is at present considered to be the preferred embodiments of the present invention, it will be understood that the invention can be embodied in other specific forms without departing from the spirit or essential characteristics thereof. For example, the number of vehicle decks can be fewer or greater than that described herein without departing from the inventive novelty of the multi-mode ship 100. Further, the bulk cargo transport system 136 can be located in another part of the multi-mode ship 100. Also, the number of vertical conveyors and conveyors can be fewer or greater than that described herein without departing from the inventive novelty described herein. The present embodiments are, therefore, to be considered in all aspects as illustrative and not restrictive. The scope of the invention is indicated by the appended claims rather than the foregoing description.

What is claimed:

1. A multi-mode ship capable of transporting different types of cargo, comprising:

a load-bearing hull having a bottom structure and a side structure;

a cargo space capable of carrying a bulk cargo defined within said hull;

at least one means for supporting vehicles located in said cargo space and attached to said load-bearing hull; and at least one means for connecting at least two of said at least one supporting means, arranged in such a way as to provide a standard roll-on/roll-off orientation between said at least one supporting means and said load bearing hull, wherein said at least one supporting means provides unimpeded flow-through of said bulk cargo to said bottom structure.

2. The multi-mode ship of claim 1, further comprising:

a means for transporting bulk cargo located within said cargo space.

3. The multi-mode ship of claim 2, wherein said means for transporting bulk cargo comprises:

a means for loading said bulk cargo within said cargo space comprising:

a means for funneling said bulk cargo located substantially adjacent to said side structure;

a means for dispensing said bulk cargo located within said cargo space; and a means for conveying said bulk cargo into said cargo space in communication with said means for funneling said bulk cargo and said means for dispensing said bulk cargo.

4. The multi-mode ship of claim 2, wherein said means for transporting bulk cargo further comprises:

a means for off-loading said bulk cargo from said cargo space comprising:

a means for conveying said bulk cargo located substantially adjacent to said bottom structure;

a means for supporting said bulk cargo located above said bulk cargo; and a means for elevating said bulk cargo from said bottom structure to said means for supporting said bulk cargo.

5. The multi-mode ship of claim 4, further comprising:

a discharge side opening located in said side structure above the waterline of said multi-mode ship; and a means for conveying said bulk cargo in communication with said means for supporting said bulk cargo for conveying said bulk cargo from said means for supporting said bulk cargo to said discharge side opening.

6. The multi-mode ship of claim 1, further comprising:

a means for storing liquid cargo located substantially adjacent to said bottom structure within said cargo space.

7. The multi-mode ship of claim 6, further comprising:

a means for loading and unloading said means for storing liquid cargo.

8. The multi-mode ship of claim 1, wherein said at least one means for supporting vehicles capable of being raised and lowered relative to said side structure.

9. A multi-mode ship capable of transporting different types of cargo, comprising:

a load-bearing hull having a bottom structure and a side structure;

a cargo space capable of carrying a bulk cargo defined within said hull;

at least one substantially grated vehicle deck located in said cargo space and attached to said load-bearing hull; and at least one vehicle ramp that connects at least two of said at least one substantially grated vehicle decks, arranged in such a way as to provide a standard roll-on/roll-off orientation between said at least one substantially grated vehicle decks and said load bearing hull, wherein said plurality of substantially grated vehicle decks provide unimpeded flow-through of said bulk cargo to said bottom structure.

10. The multi-mode ship of claim 9, further comprising:

a bulk cargo transport system located within said cargo space.

11. The multi-mode ship of claim 10, wherein said bulk cargo transport system comprises:

a bulk cargo self loading portion comprising:

at least one hopper located substantially adjacent to said side structure;

at least one loading chute located within said cargo space; and at least one loading conveyor projecting into said cargo space in communication with said at least one hopper and said at least one loading chute.

12. The multi-mode ship of claim 10, wherein said bulk cargo transport system further comprises:

a bulk cargo self off-loading portion comprising:

at least one lower conveyor located substantially adjacent to said bottom structure;

at least one upper conveyor located above said bottom structure; and at least one substantially vertical conveyor having a first end and a second end, said first end in communication with said at least one lower conveyor and said second end in communication with said at least one upper conveyor.

13. The multi-mode ship of claim 12, further comprising:

a discharge side opening located in said side structure above the waterline of said multi-mode ship; wherein said at least one upper conveyor transports said bulk cargo from said at least one substantially vertical conveyor to said discharge side opening.

14. The multi-mode ship of claim 11, further comprising:

a longitudinal conveyor below said loading chute, wherein said longitudinal conveyor distributes bulk cargo prior to said bulk cargo gravity feeding through said at least one substantially grated vehicle decks.

15. The multi-mode ship of claim 9, further comprising:

at least one liquid storage tank located adjacent to said bottom structure within said cargo space.

16. The multi-mode ship of claim 15, wherein said at least one liquid storage tank further comprises:

a slope plate, said slope plate sloped to facilitate the gravity feeding of bulk cargo toward said at least one lower conveyor.

17. The multi-mode ship as in claims 11, 12, 13, or 14, wherein said conveyors is a conveyor selected from the group consisting of screw-type conveyors, belt conveyors, bucket conveyors, pneumatic conveyors and pocket belt conveyors.

18. A multi-mode ship capable of transporting different types of cargo, comprising:

a load-bearing hull having a bottom structure and a side structure;

a cargo space capable of carrying a bulk cargo defined within said hull;

at least one liquid storage tank having slope plates located within said cargo space and adjacent said bottom structure, said slope plates forming bulk cargo troughs within said bottom structure;

at least one substantially grated vehicle deck located in said cargo space and attached to said load-bearing hull;

at least one substantially non-grated vehicle deck located above said at least one substantially grated vehicle deck and attached to said load-bearing hull; and at least one vehicle ramp that connects at least two of any one said at least one substantially grated vehicle deck, arranged in such a way as to provide a standard roll-on/roll-off orientation between said at least one substantially grated vehicle deck and said load bearing hull, and said at least one substantially grated vehicle deck provides unimpeded flow-through of said bulk cargo to said bottom structure.

19. The multi-mode ship of claim 18, further comprising:

a bulk cargo transport system located within said cargo space.

20. The multi-mode ship of claim 19, wherein said bulk cargo transport system comprises:

a bulk cargo self loading portion comprising:

a hopper located substantially adjacent to said side structure;

a loading chute, said loading chute located within said cargo space; and a loading conveyor projecting into said cargo space in communication with said hopper and said loading chute.

21. The multi-mode ship of claim 19, wherein said bulk cargo transport system comprises:

a bulk cargo self off-loading portion comprising:

at least one vertical conveyor having a first end and a second end located in said cargo space;

at least one lower longitudinal conveyor adjacent to said bottom structure within said cargo space, having a distal end and a proximal end, said distal end of said lower longitudinal conveyor located in said bulk cargo troughs and said proximal end of said lower longitudinal conveyor extending to said first end of said vertical conveyor of said cargo space.

22. The multi-mode ship of claim 21, further comprising:

a discharge side opening located in said side structure above the waterline of said multimode ship; wherein at least one upper transverse conveyor transports said bulk cargo from said at least one substantially vertical conveyor to said discharge side opening.

23. The multi-mode ship of claim 22, wherein said at least one vertical conveyor is located outside of said cargo space.

24. The multi-mode ship of claim 22, wherein said at least one vertical conveyor is located partially inside said cargo space and partially outside said cargo space.

25. The multi-mode ship as in claims 21, 23, or 24 further comprising:

at least one upper transverse conveyor located above said bottom structure;

at least one lower transverse conveyor adjacent to said bottom structure within said cargo space, said at least one lower transverse conveyor in communication with said proximal end of said lower longitudinal conveyor; and said first end of said vertical conveyor in communication with said at least one lower transverse conveyor and said second end of said vertical conveyor in communication with said at least one upper transverse conveyor.

26. A bulk cargo transport system for a ship having a load-bearing hull with a bottom structure and a side structure defining a cargo space, comprising:

at least one substantially grated vehicle deck having an opening, said at least one substantially grated vehicle deck oriented in a horizontal plane and spaced apart from each other within said cargo space and substantially overlapping one another and attached to said side structure;

wherein said openings aligned one above another to form a linear passage; and at least one vertical conveyor oriented within said linear passage for transporting said bulk cargo from said bottom structure to a vertical feed collector located above bottom structure.

27. The bulk cargo transport system of claim 26, further comprising:

at least one lower conveyor located substantially adjacent to said bottom structure within said cargo space, having a first end and a second end, said first end in communication with said vertical conveyor and said second end extending outward from said vertical conveyor.

28. The bulk cargo transport system of claim 27, further comprising:

at least one transverse conveyor, said at least one transverse conveyor having a first end and a second end, said first end in communication with said first end of said lower conveyor and said second end in communication with said vertical conveyor.

29. A method for loading bulk cargo on a multi-mode ship comprising a load-bearing hull having a bottom structure and a side structure; a cargo space capable of carrying a bulk cargo defined within said hull, at least one substantially grated vehicle deck located in said cargo space and attached to said load-bearing hull, at least one vehicle ramp that connects at least two of said at least one substantially grated vehicle decks, arranged in such a way as to provide a standard roll-on/roll-off orientation between said at least one substantially grated vehicle deck, at least one hopper located substantially adjacent to said side structure, at least one loading chute located within said cargo space, at least one loading conveyor projecting into said cargo space in communication with said at least one hopper and said at least one loading chute, said method comprising:

charging said hopper with said bulk cargo;

operating said at least one loading conveyor to transport said bulk cargo toward said at least one loading chute;

discharging said bulk cargo from said at least one loading chute, wherein said bulk cargo falls unimpeded through said at least one grated vehicle deck toward said bottom structure;

piling said bulk cargo from said bottom structure upwards through the at least one substantially grated vehicle deck; and ceasing said charging once said bulk cargo has reached a desired quantity within said cargo space.

30. A method for off-loading bulk cargo from a multi-mode ship comprising a load-bearing hull having a bottom structure and a side structure; a cargo space capable of carrying a bulk cargo defined within said hull, at least one substantially grated vehicle deck located in said cargo space and attached to said load-bearing hull, at least one vehicle ramp that connects at least two of said at least one substantially grated vehicle deck, arranged in such a way as to provide a standard roll-on/roll-off orientation between said at least one substantially grated vehicle deck, at least one lower conveyor located substantially adjacent to said bottom structure within said cargo space, at least one upper conveyor, at least one substantially vertical conveyor having a first end and a second end, said first end in communication with said at least one lower conveyor and said second end in communication with said at least one upper conveyor, a discharge side opening located above the waterline of said multi-mode ship, said method comprising:

operating said at least one substantially vertical conveyor to raise said bulk cargo from said cargo space;

operating at least one lower transverse conveyor to transport said bulk cargo toward said at least one substantially vertical conveyor;

discharging said bulk cargo onto said at least one upper conveyor;

operating said at least one upper conveyor to transport said bulk cargo toward said discharge side opening;

discharging said bulk cargo out said discharge side opening; and discharging all of said bulk cargo from said cargo space.

31. The method of claim 30, further comprising:

cleaning said cargo space;

driving said vehicles onto said mufti-mode ship; and using said at least one vehicle ramp to transport said vehicles to said at least one substantially grated vehicle deck.

32. The method of claim 30, further comprising: loading liquid cargo onto said multi-mode ship.

* * * * *